US010329050B2

(12) United States Patent
Kasha

(10) Patent No.: US 10,329,050 B2
(45) Date of Patent: Jun. 25, 2019

(54) DOUBLE-WALLED ARTICLES FOR RECEIVING DECORATIVE FILLER MATERIALS

(71) Applicant: Adam Kasha, Ann Arbor, MI (US)

(72) Inventor: Adam Kasha, Ann Arbor, MI (US)

( * ) Notice: Subject to any disclaimer, the term of this patent is extended or adjusted under 35 U.S.C. 154(b) by 0 days.

(21) Appl. No.: 15/647,196

(22) Filed: Jul. 11, 2017

(65) Prior Publication Data

US 2017/0305594 A1 Oct. 26, 2017

Related U.S. Application Data

(63) Continuation-in-part of application No. 14/931,379, filed on Nov. 3, 2015, now Pat. No. 9,706,862, which
(Continued)

(51) Int. Cl.
*B65D 6/00* (2006.01)
*B65D 13/02* (2006.01)
(Continued)

(52) U.S. Cl.
CPC ..... *B65D 11/20* (2013.01); *A47G 7/06* (2013.01); *B65D 11/02* (2013.01); *B65D 11/10* (2013.01);
(Continued)

(58) Field of Classification Search
CPC ... A47G 7/06; A47G 7/02; B65D 7/22; B65D 9/26; B65D 11/16; B65D 11/20; B65D 11/02; B65D 11/10; B65D 1/20; B65D 1/04; B65D 1/06; B65D 13/02; B65D 13/00; B65D 39/04; B65D 25/54;
(Continued)

(56) References Cited

U.S. PATENT DOCUMENTS 1,551,778 A * 9/1925 Altenberg ..... A47J 41/028 220/592.16
2,084,568 A * 6/1937 White ..... B65D 41/0442 220/288
(Continued)

FOREIGN PATENT DOCUMENTS

DE 3506780 A1 * 8/1986 ..... A47G 23/04

OTHER PUBLICATIONS

Translation of DE 3506780, Zimmermann, (Aug. 28, 1986), pp. 3-4 (Year: 1986).*

*Primary Examiner* — Robert J Hicks
(74) *Attorney, Agent, or Firm* — John G. Posa; Belzer PC

(57) ABSTRACT

Double-walled decorative articles such as flower vases and candle holders comprise an inner form defining a receptacle and an outer form, spaced apart from the inner form, to create a cavity. A bottom opening in the outer form enables decorative filler materials to be introduced to the cavity such that the decorative materials do not enter into the receptacle, which may contains flowers, water, candles, hot wax or other substances. A removably replaceable plug or cap is used to close off the bottom opening following the introduction of the decorative filler materials. The inner and outer forms may be provided as a unitary item or separate pieces may be joined. The decorative filler materials may be provided in conjunction with the article as part of a kit, in which case the amount of filler material is matched to the volume of the cavity.

7 Claims, 28 Drawing Sheets

Related U.S. Application Data is a continuation-in-part of application No. 14/265,675, filed on Apr. 30, 2014, now Pat. No. 9,173,511.

(60) Provisional application No. 61/907,711, filed on Nov. 22, 2013.

(51) Int. Cl.

| | |
|---|---|
| ***B65D 8/00*** | (2006.01) |
| ***B65D 85/50*** | (2006.01) |
| ***A47G 7/06*** | (2006.01) |
| *F21V 35/00* | (2006.01) |
| *F21W 121/00* | (2006.01) |

(52) U.S. Cl.

CPC ..... *B65D 13/02* (2013.01); *B65D 85/505* (2013.01); *F21V 35/00* (2013.01); *F21W 2121/00* (2013.01)

(58) Field of Classification Search

CPC .... B65D 25/22; B65D 25/24; B65D 21/0233; B65D 85/505; B65D 85/50

USPC ..... 220/62.15, 62.18, 62.11, 602, 601, 665, 220/662, 634, 636, 630, 628; 47/41.01; 215/6, 10; 206/457

See application file for complete search history.

(56) References Cited

U.S. PATENT DOCUMENTS

| | | | | | |
|---|---|---|---|---|---|
| 3,339,770 | A * | 9/1967 | Weigand | B65D 41/06 | 215/214 |
| 3,441,161 | A * | 4/1969 | Van Baarn | B65D 41/0421 | 215/235 |
| 3,622,028 | A * | 11/1971 | Lohrer | B65D 1/0246 | 215/253 |
| 4,941,590 | A * | 7/1990 | Pantaleo | A47G 19/2227 | 206/217 |
| 5,261,554 | A * | 11/1993 | Forbes | A45C 11/20 | 220/592.16 |
| 5,979,706 | A * | 11/1999 | Grussmark | A61C 15/043 | 222/105 |
| 2013/0228544 | A1* | 9/2013 | Benetti | A47G 19/2255 | 215/378 |

* cited by examiner

DOUBLE-WALLED ARTICLES FOR RECEIVING DECORATIVE FILLER MATERIALS

REFERENCE TO RELATED APPLICATION

This application is a Continuation-in-Part (CIP) of U.S. patent application Ser. No. 14/931,379, now U.S. Pat. No. 9,706,862, which is a CIP of U.S. patent application Ser. No. 14/265,675, now U.S. Pat. No. 9,173,511, the entire content of both applications being incorporated herein by reference.

FIELD OF THE INVENTION

This invention relates generally to vases, candleholders, and like articles and, in particular, to double-walled articles configured to receive decorative filler materials.

BACKGROUND OF THE INVENTION

Double-walled vessels have been in existence for many years for various purposes. U.S. Pat. No. 116,401, for example, provides a vase which can be supplied with water by its own action after the reservoir is once filled, and thus save much trouble and time now required to take care of plants in vases used to decorate cemetery lots or other places remote from the residence of the owner. To accomplish this goal, a vase or flower-pot has double walls providing a reservoir for water or air, and the necessary pipes, for the purposes specified.

U.S. Pat. No. 650,614 relates to flower pots and vases and the like; and it consists in providing these receptacles with double walls inclosing a stagnant layer of air and in providing the bottoms of the same with inwardly and upwardly extending tubes or pipes instead of the ordinary orifices generally employed. The pot or vase is provided with double walls, closed at the top by an annular ring, and open at the bottom, which closes up the inner wall only. The effect produced by the double-walled pot is that the roots of the plants therein will not be subjected to sudden changes of temperature, because the stagnant layer of air within the walls constitutes a poor conductor of heat, and thus compensates for sudden temperature changes.

U.S. Pat. No. 4,065,016 discloses a compound vessel formed of a transparent material having a spheroidal main body. The main body is comprised of spheroidal inner and outer walls with an annular space defined therebetween. The annular space constitutes an outer vessel of the compound vessel and the space contained by the inner wall constitutes an inner vessel of the compound vessel. The outer and inner walls join at one extremity of the spheroidal main body of the compound vessel to close the outer vessel and form the periphery of a generally circular mouth opening into the inner vessel, the inner vessel being otherwise closed. The outer wall terminates at an opposite extremity of the spheroidal main body of the compound vessel to form the periphery of a generally circular mouth opening into the outer vessel, the outer vessel being otherwise closed.

U.S. Pat. No. 4,525,950 describes a receptacle usable as a flower vase, and especially adapted to present the illusion of being filled with a liquid to a level called the "illusion line." The vase has an inner tubular insert sealed to an outer receptacle at the common rim of the outer receptacle and tubular insert. The outer receptacle and tubular insert define between them a cavity or space which can be filled with a transparent fluid. In use, artificial flowers or any decorative material that one might wish to store dry can be placed within the inner tubular insert, and the liquid within the cavity will present the illusion of the receptacle being completely filled with liquid, and the decorative material being immersed in this liquid.

According to U.S. Pat. No. 7,082,714, a vessel provides a decorative display of a floral arrangement or like items utilizing a reservoir of liquid for providing visual effects, with the items placed within the reservoir and extending upwardly out of the reservoir, and a light source within an inner chamber surrounded by the reservoir, the walls of the reservoir being light-transmitting and the inner chamber being flared radially outwardly and upwardly to dissipate heat from the light source and to deflect the items radially outwardly away from the heat emanating from the light source.

In U.S. Pat. No. 8,033,412, a double-walled drinking vessel, e.g., a tumbler, is described that is constructed of a downwardly tapered outer wall with a bottom and a continuous side wall with an upper rim; an inner wall with a bottom and a continuous side wall with an upper rim, the inner wall being spaced inwardly from the outer wall and including a first downwardly tapered section extending downwardly from the rim, a second downwardly tapered section extending upwardly from the bottom, and a continuous cylindrical section of a given height and diameter between the first and second tapered sections; and a decorative fabric band secured around the cylindrical section, the band having a width approximately equal to the width of the cylindrical section and a length at least as great as the diameter of the cylindrical band.

SUMMARY OF THE INVENTION

This invention resides in double-walled decorative articles such as flower vases and candle holders. Such articles comprise an inner form defining a receptacle and an outer form, spaced apart from the inner form, to create a cavity. A bottom opening in the outer form enables decorative filler materials to be introduced to the cavity such that the decorative materials do not enter into the receptacle, which may contains flowers, water, candles, hot wax or other substances. A removably replaceable plug or cap is used to close off the bottom opening following the introduction of the decorative filler materials.

The inner and outer forms may be provided as a unitary item or separate pieces may be joined. The inner and outer forms may be made of glass, plastic or other transparent or translucent materials. The inner and outer forms may have the same or different cross sections. The decorative filler materials may be provided in conjunction with the article as part of a kit, in which case the amount of filler material is matched to the volume of the cavity by way of an initial pouring in to the cavity, for example.

DETAILED DESCRIPTION OF THE INVENTION

Figure 1:
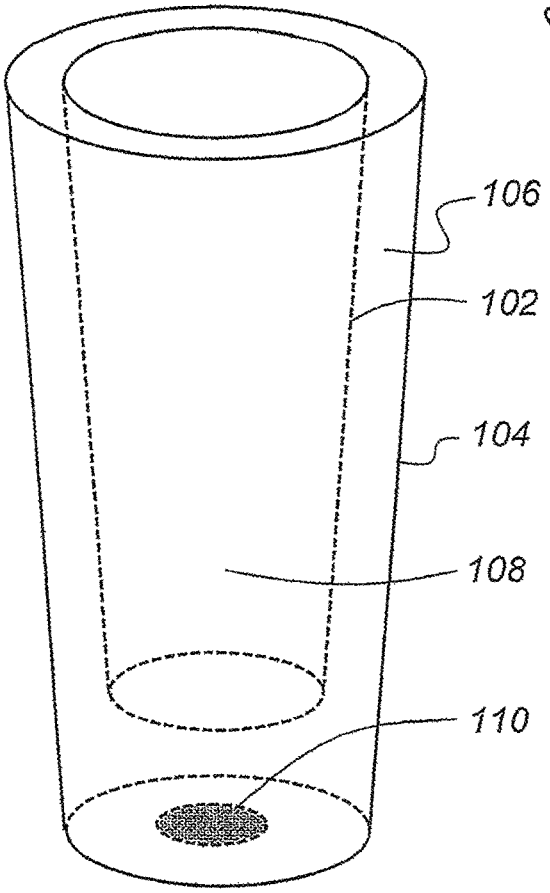
FIG. 1 illustrates a preferred embodiment of the invention.

This invention resides in double-walled articles and methods of making the same. The preferred embodiments include different shapes and sizes of flower vases and candle holders. FIG. 1 is a drawing of an embodiment of the invention. All embodiments include an aperture formed on a lower surface for gaining access to the space between the double walls. This enables the articles according to this invention to be filled with decorative filler materials that do not interfere with the candle or plant holding receptacles which may contain hot wax or water. In all embodiments a cap may be provided to seal off the aperture once the decorative filler materials have been introduced.

Figure 2:
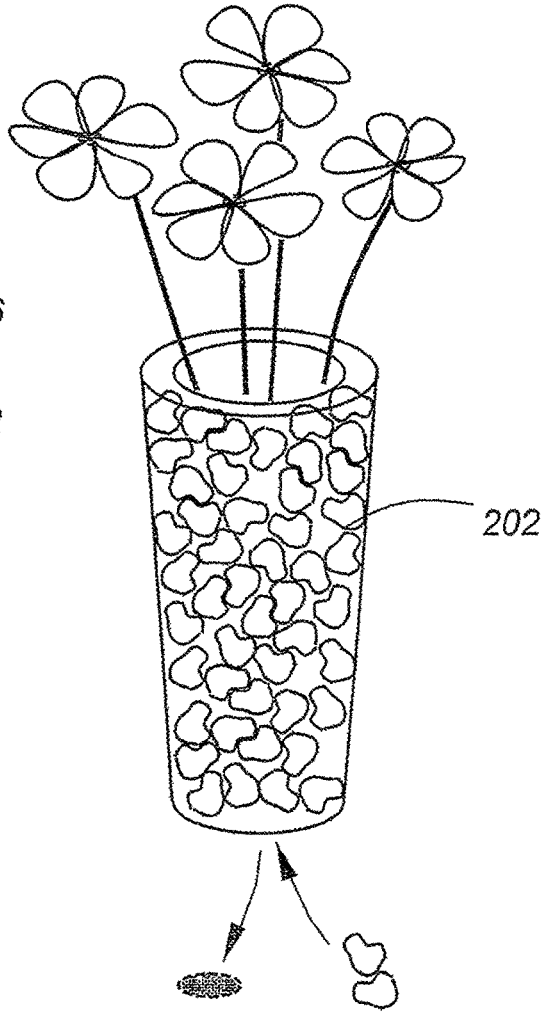
FIG. 2 shows the article of FIG. 1 with loaded filler material(s)

FIG. 1 illustrates a preferred embodiment of the invention. The article, preferably of glass, includes an inner wall 102, and an outer wall 104 creating a volume that may be filled with decorative materials 202 as shown in FIG. 2. Generally the article is turned upside, down as shown in FIGS. 15A-15F, or on its side to feed the filler materials into the volume 106. Such materials may include glass gems, glass pebbles, sea glass, decorative sands, decorative stones and pebbles, plastic gems and icons, wood, liquid and any other alternatives as long as the materials can be loaded through removable/replaceable plug 110. Inner wall 102 creates a vase 108 that may be filled with water, flowers, etc. Due to the way in which the article is constructed, the decorative accents do not contact with the contents of the vase 108.

Figure 3:
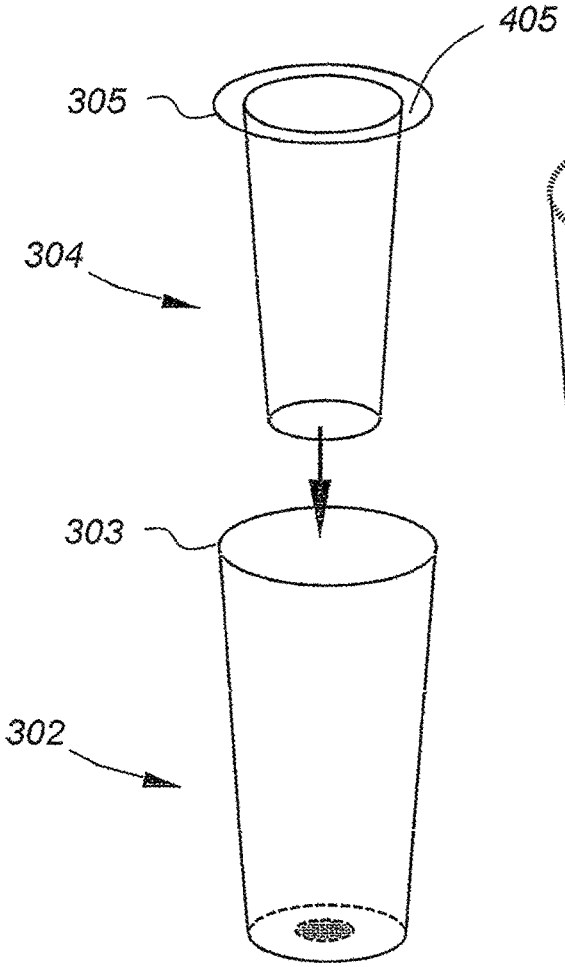
FIG. 3 depicts a two-piece, double-walled construction.

Articles according to the invention may be constructed entirely from pressed or blown glass, though such techniques may be expensive. As such, a two-piece construction may be used as shown in FIG. 3. This process involves an outer form 302 connected to an inner form 304. An advantage of this approach is that the inner and outer forms may be made of different colors of glass, or even different materials. For example, the outer form may be made of clear glass and the inner shape may be colored glass. Alternatively, the inner shape may be made of plastic or metal, with the outer shape being made of glass or plastic.

Figure 4:
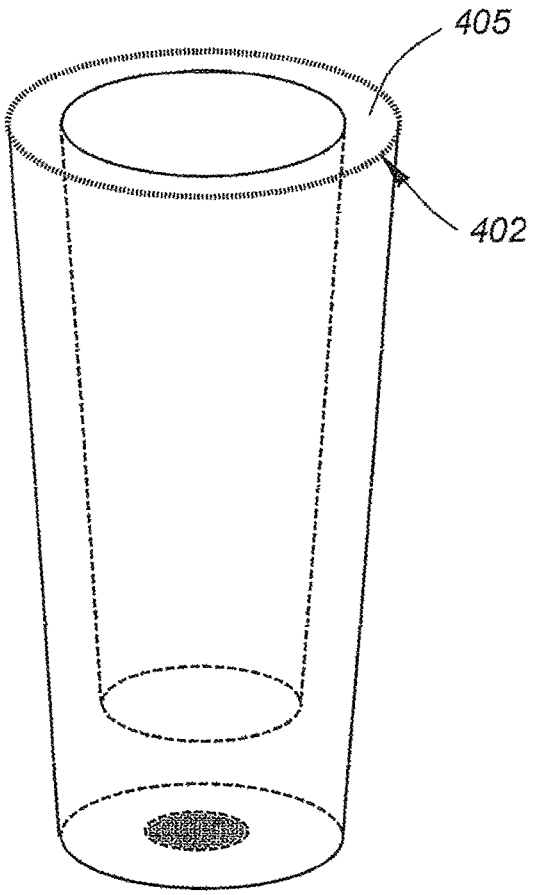
FIG. 4 shows the edge associated with joining the inner and outer forms of FIG. 3.

In FIG. 3, outer form 302 includes an upper edge 303 that is joined to an edge 305 of inner form 304. Inner form 304 may include a formed lip 405 enabling filler material to occupy volume 106 further up the completed article. FIG. 4 shows the edge 402 associated with joining the inner and outer forms 304, 302. If both forms are of glass such as borosilicate glass, interface 402 may be formed and closed with a torch. If different glasses or other materials are used, interface 402 may be made with a suitable bonding agent, including ultraviolet-cured adhesives.

Figure 5:
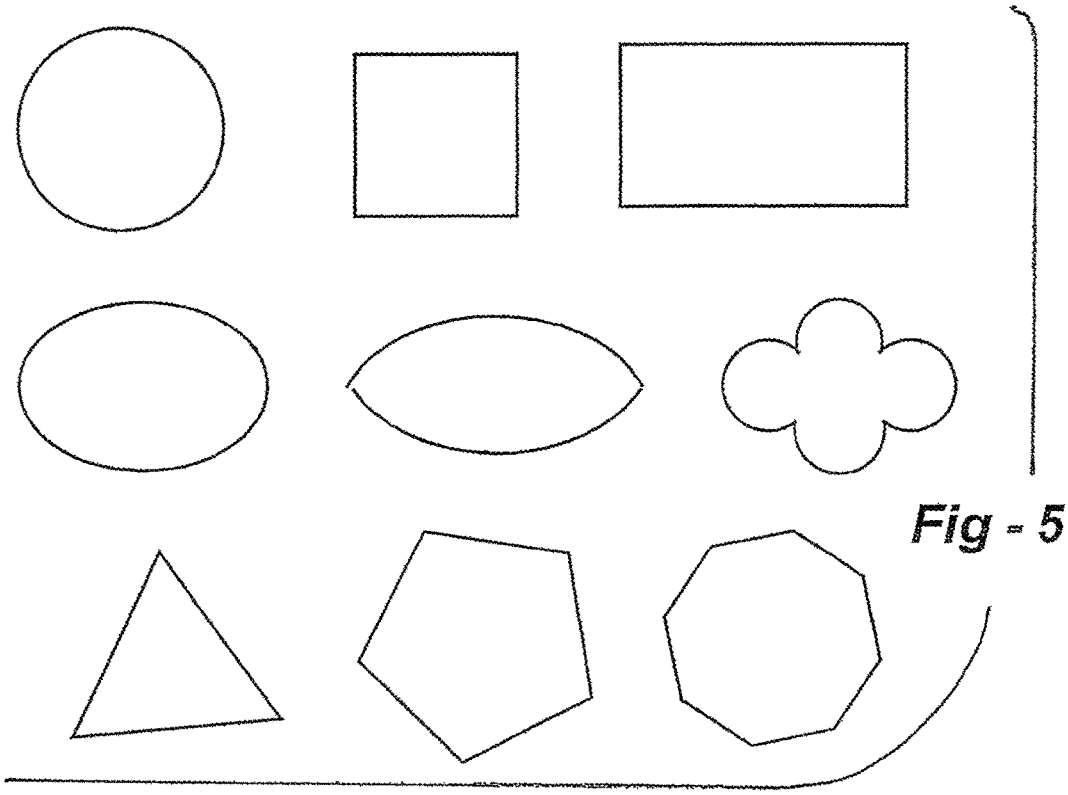
FIG. 5 shows various cross sections applicable to either the inner or the outer forms.
Figure 6:
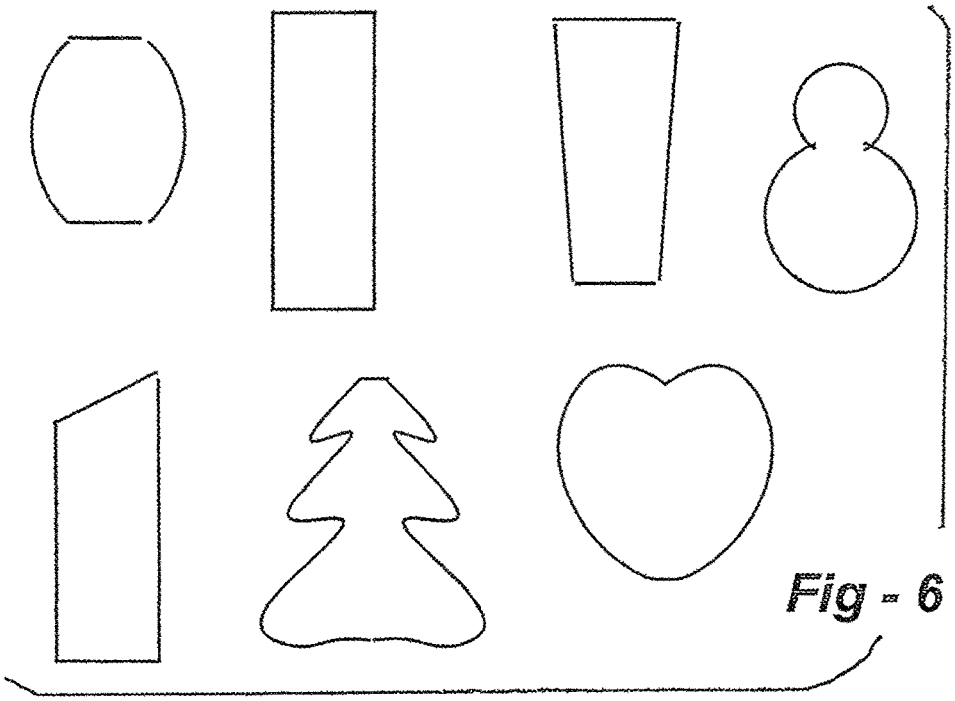
FIG. 6 presents side views that may be used for at least the outer form.
Figure 7:
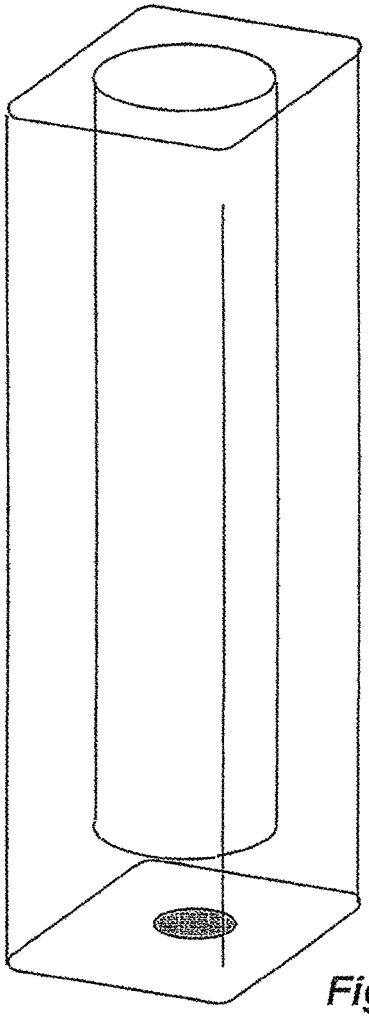
FIG. 7 shows how a square outer shape may be combined with a cylindrical inner form.
Figure 8:
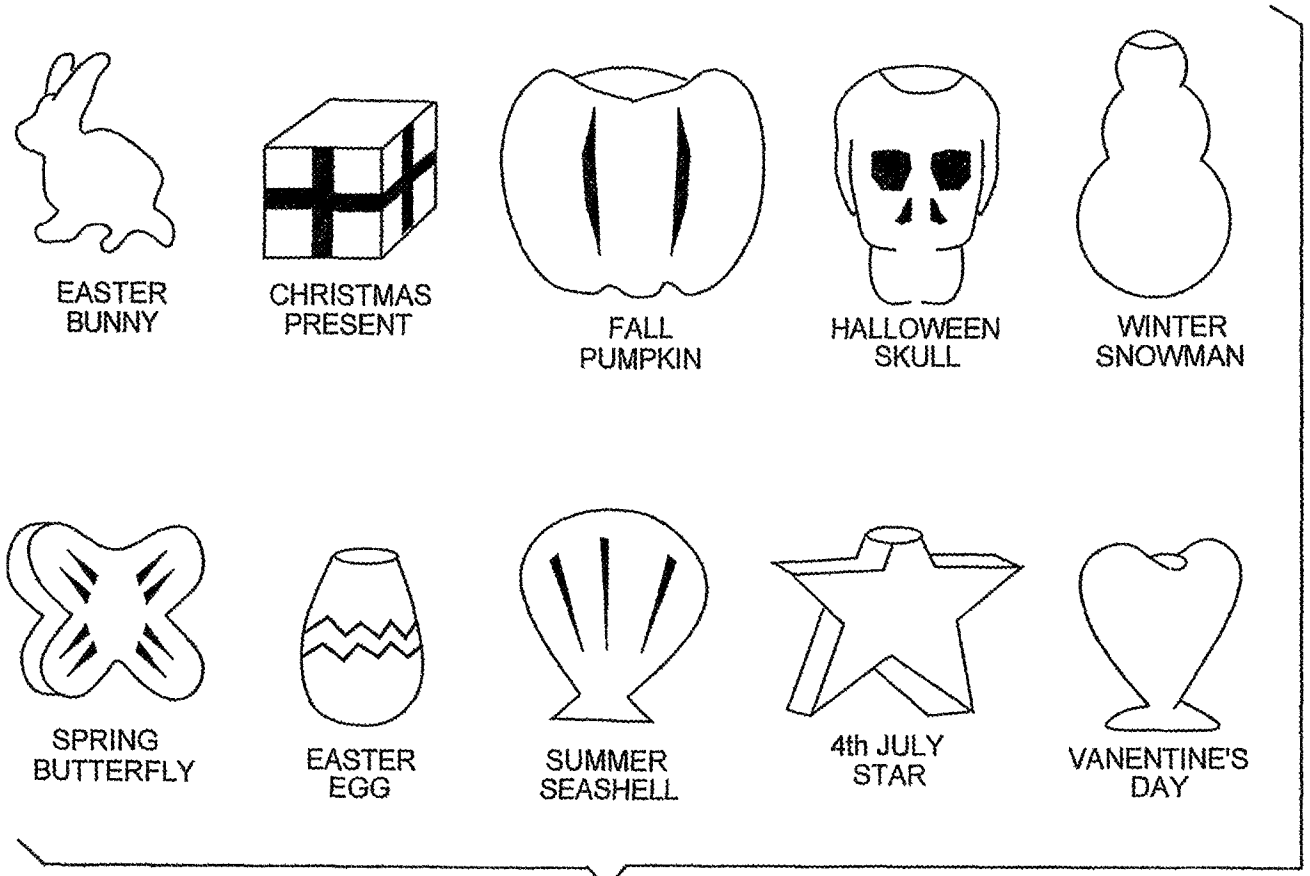
FIG. 8 illustrates other possible form and shape combinations.

While FIGS. 1-4 show conical inner and outer forms, different shapes may be mixed and matched. FIG. 5 shows various cross sections applicable to either the inner or the outer forms. FIG. 6 shows side views that may be used for either form. FIG. 7 shows, for example, a square outer shape with a cylindrical inner shape. A myriad other combinations are possible. FIG. 8, for example, illustrates outer shapes directed to holidays, and the like. In each case, a simpler inner form such as a cylindrical cup is used to hold flowers, candles, etc. Although not apparent in FIG. 8 the bottom of each form further includes a port and cap to receive and retain filler material(s).

Figure 9:
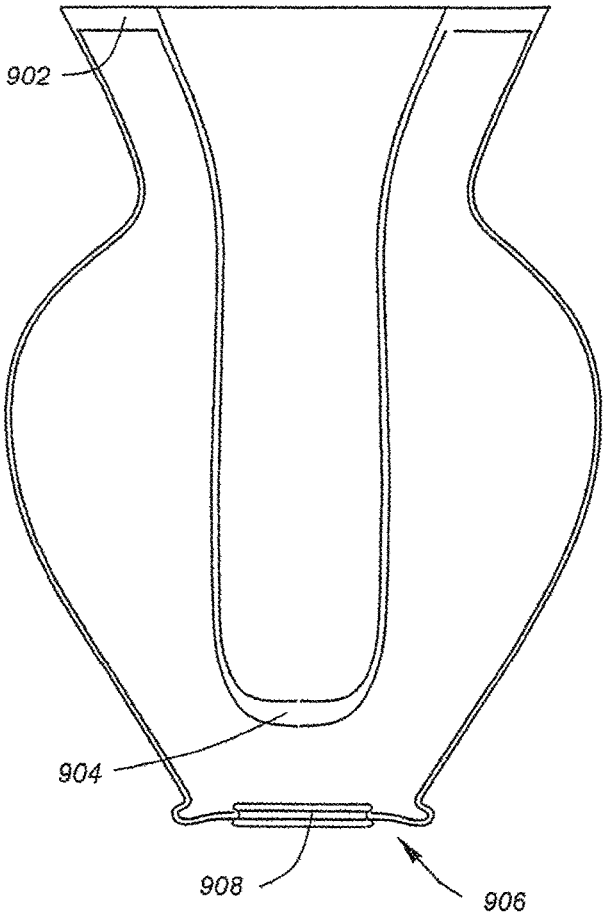
FIG. 9 illustrates options that may be desirable is some instances.

FIG. 9 illustrates options that may be desirable is some instances. For example, areas 902, 904 may be strengthened or fortified against filler materials striking these areas during filling. Further, a central portion of the bottom 906 may be recessed so that plug 908, typically made of plastic or rubber, does not extend outwardly from the bottom, which may lead to instability. A double-walled vase and filler material may be provided in a kit form, in which case the volume of the cavity between the inner and out walls may be measured (with water, for example), enabling a precise amount of filler material to be provided in the kit to fill the cavity to a desired level, including full, ⅔ full, half full, and so forth.

Figure 10A:
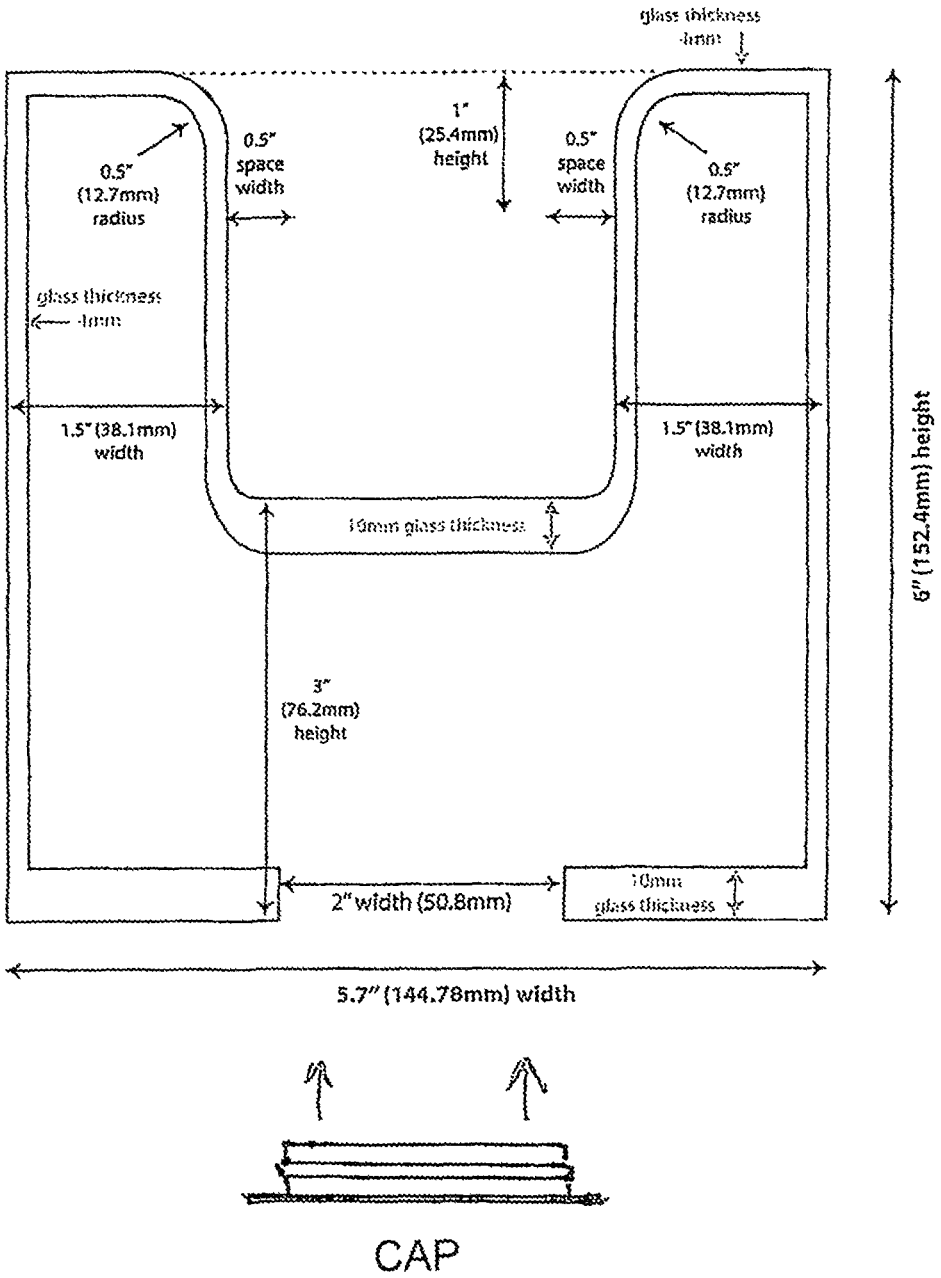
FIG. 10A is a cross section of a votive candle vase constructed in accordance with the invention including a set of preferred dimensions.
Figure 10B:
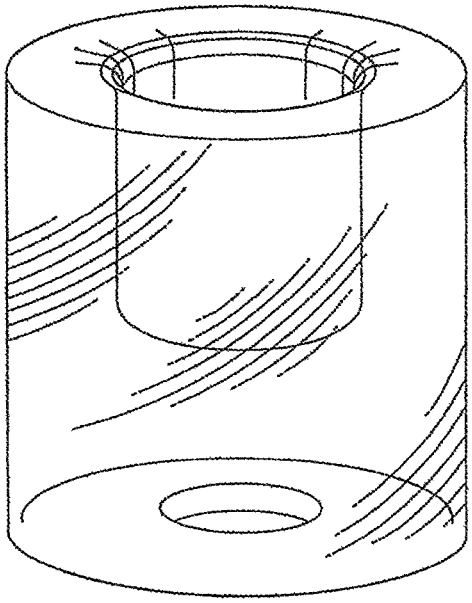
FIG. 10B is an oblique view of the votive candle vase of FIG. 10A.
Figure 10C:
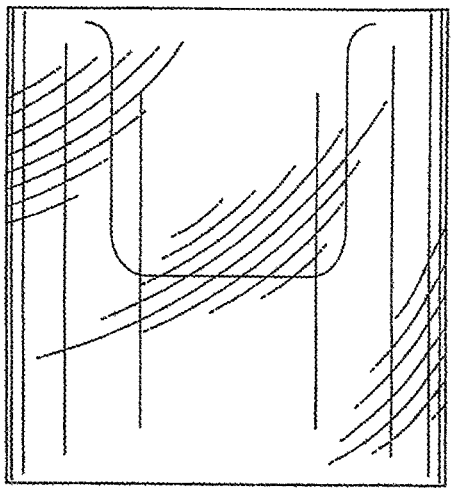
FIG. 10C is a side view of the votive candle vase of FIG. 10A.
Figure 10D:
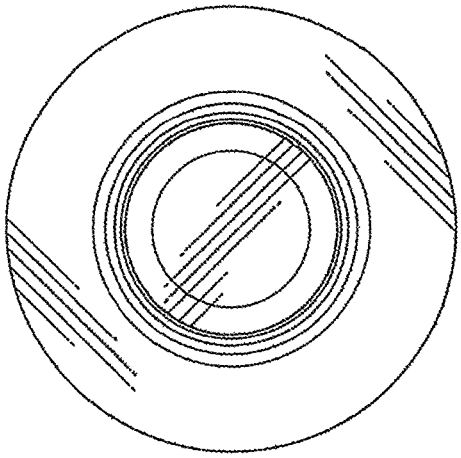
FIG. 10D is a top view of the votive candle vase of FIG. 10A.
Figure 10E:
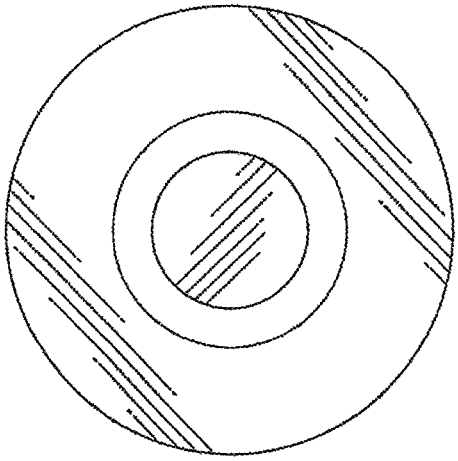
FIG. 10E is a bottom view of the votive candle vase of FIG. 10A.

FIG. 10A is a cross section of a votive candle vase constructed in accordance with the invention including a set of preferred dimensions. FIG. 10B is an oblique view of the votive candle vase of FIG. 10A; FIG. 10C is a side view, FIG. 10D is a top view, and FIG. 10E is a bottom view.

Figure 11A:
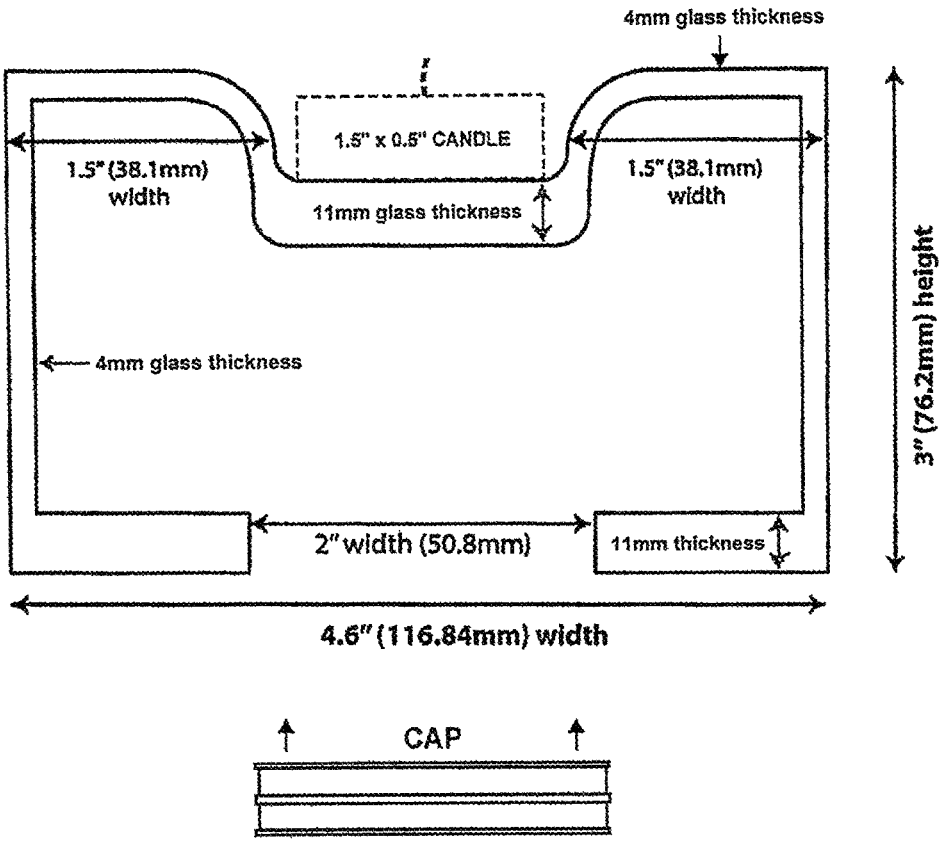
FIG. 11A is a cross section of a tea light vase constructed in accordance with the invention including a set of preferred dimensions.
Figure 11B:
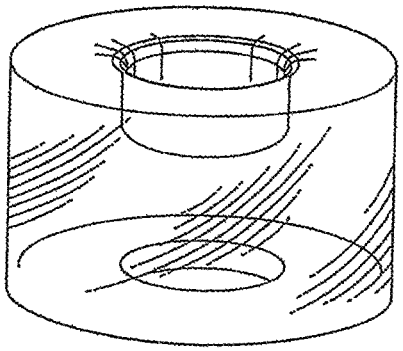
FIG. 11B is an oblique view of the tea light vase of FIG. 11A.
Figure 11C:
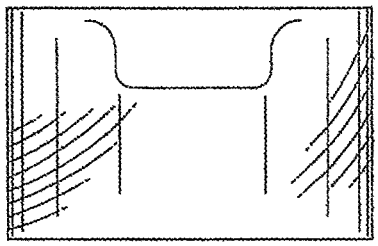
FIG. 11C is a side view of the tea light vase of FIG. 11A.
Figure 11D:
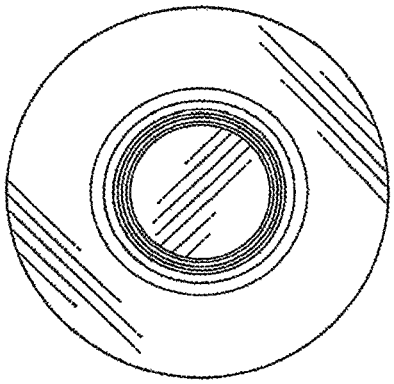
FIG. 11D is a top view of the tea light vase of FIG. 11A.
Figure 11E:
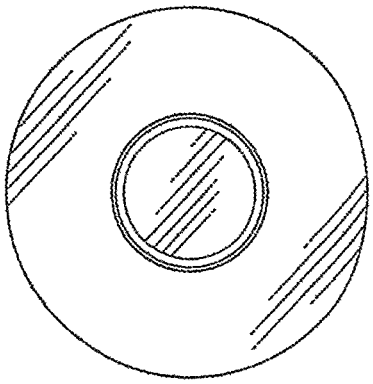
FIG. 11E is a bottom view of the tea light vase of FIG. 11A.

FIG. 11A is a cross section of a tea light vase constructed in accordance with the invention including a set of preferred dimensions. FIG. 11B is an oblique view of the tea light vase of FIG. 11A; FIG. 11C is a side view, FIG. 11D is a top view, and FIG. 11E is a bottom view.

Figure 12A:
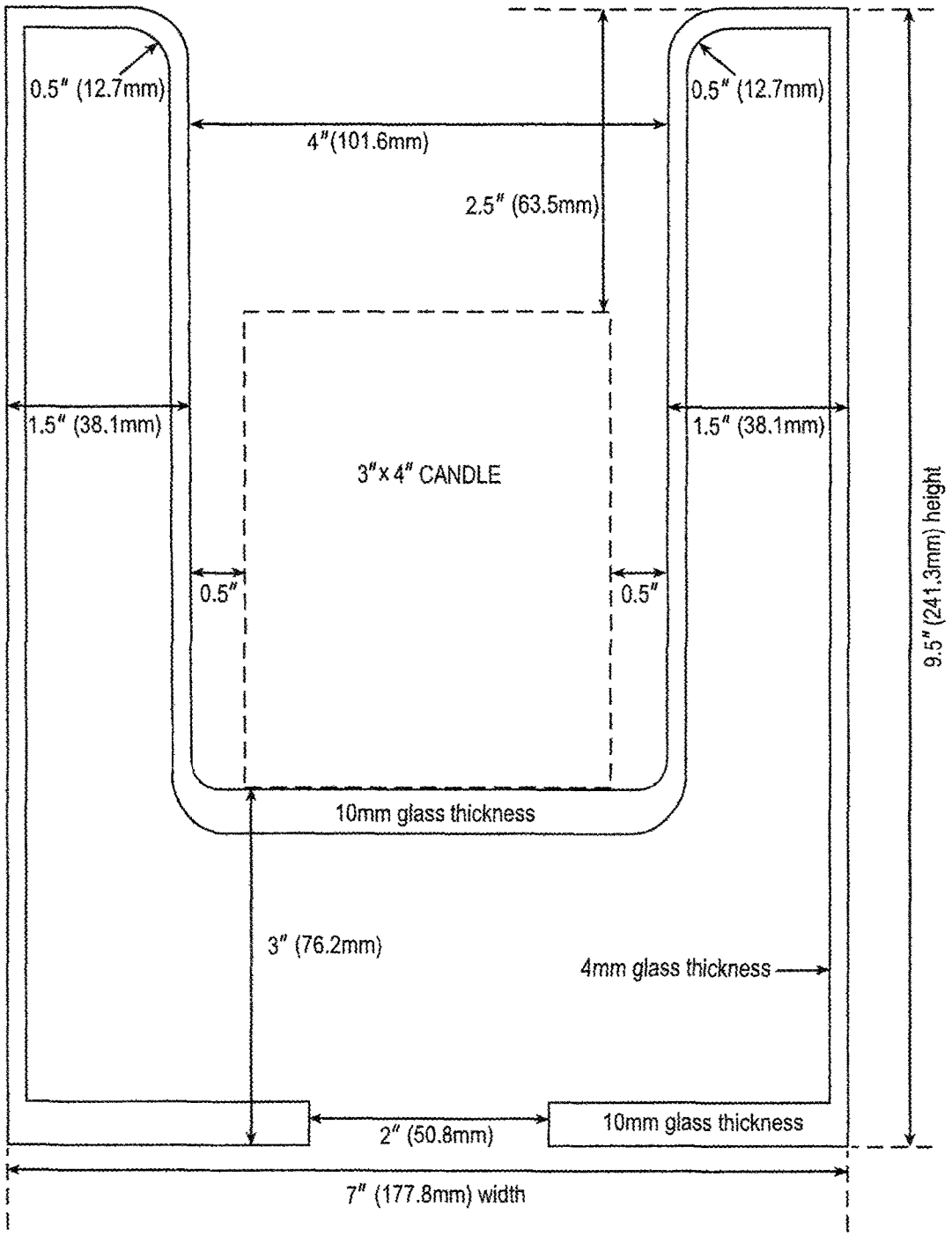
FIG. 12A is a cross section of a standard pillar vase constructed in accordance with the invention including a set of preferred dimensions.
Figure 12B:
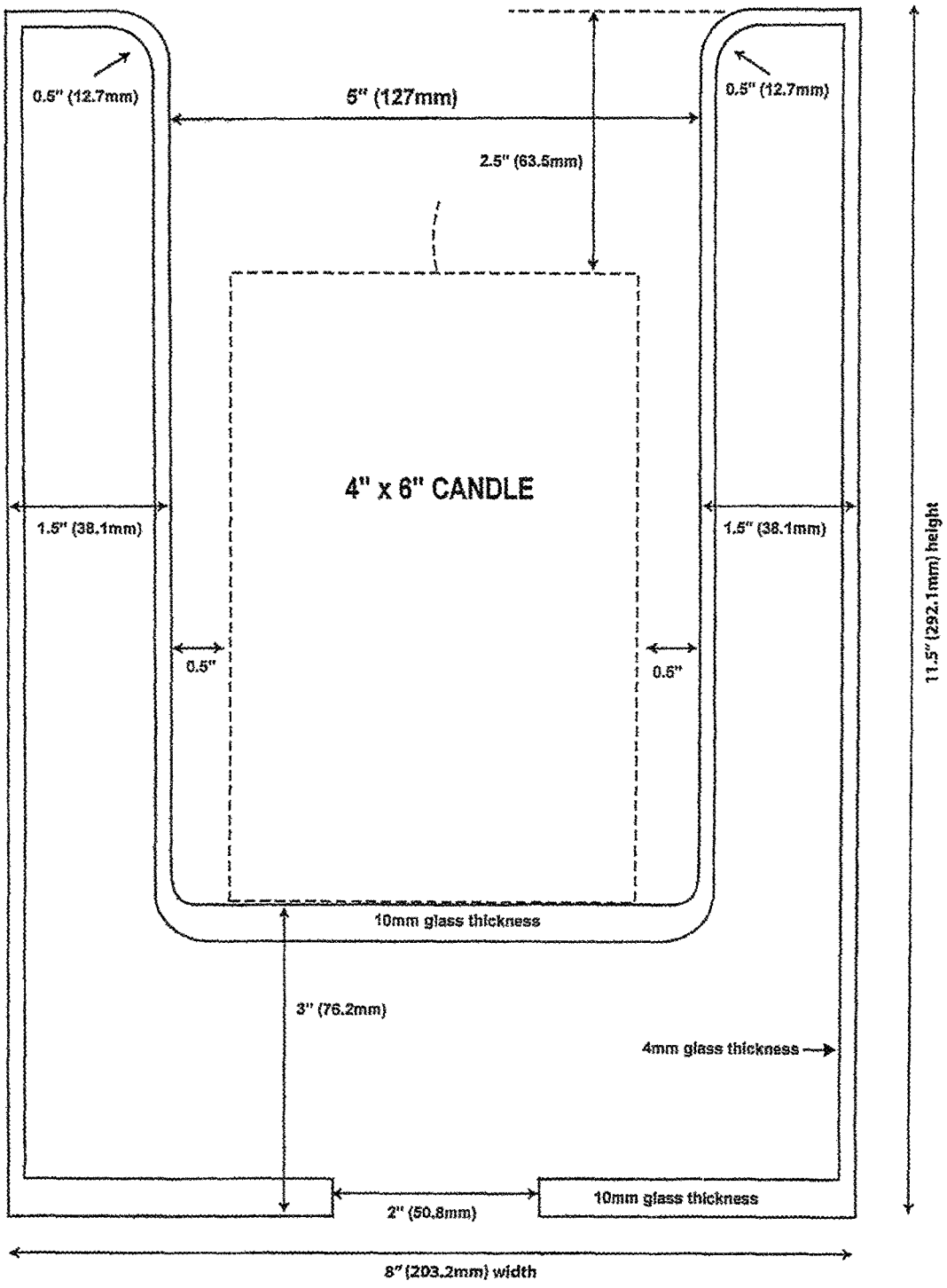
FIG. 12B is a cross section of a tall pillar vase constructed in accordance with the invention including a set of preferred dimensions.
Figure 12C:
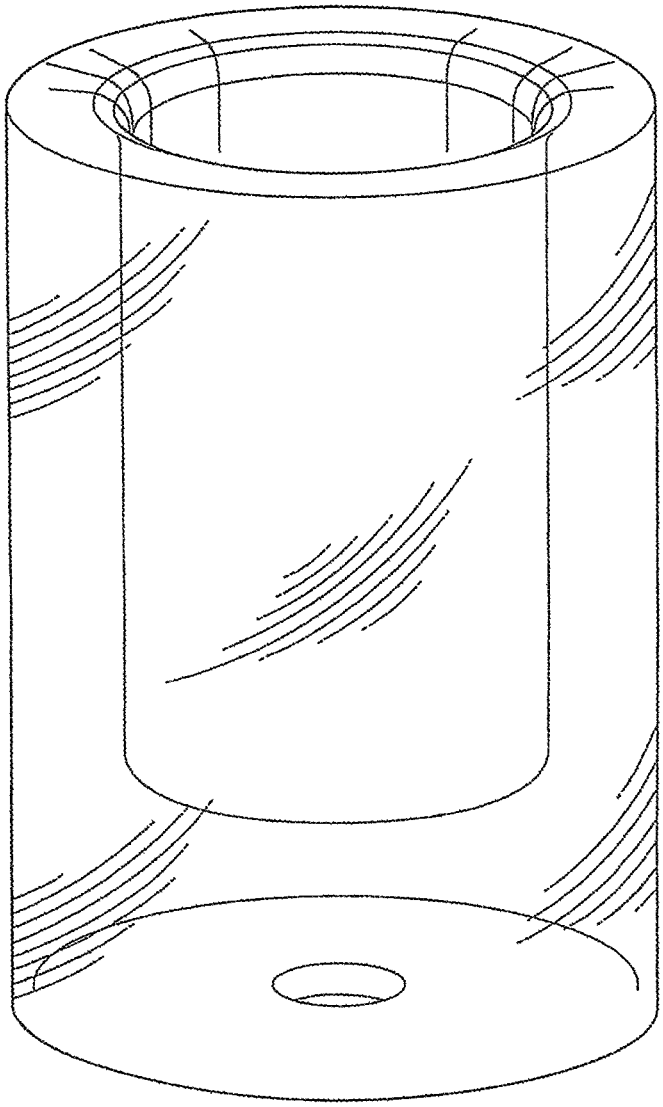
FIG. 12C is an oblique view of a pillar vase.
Figure 12D:
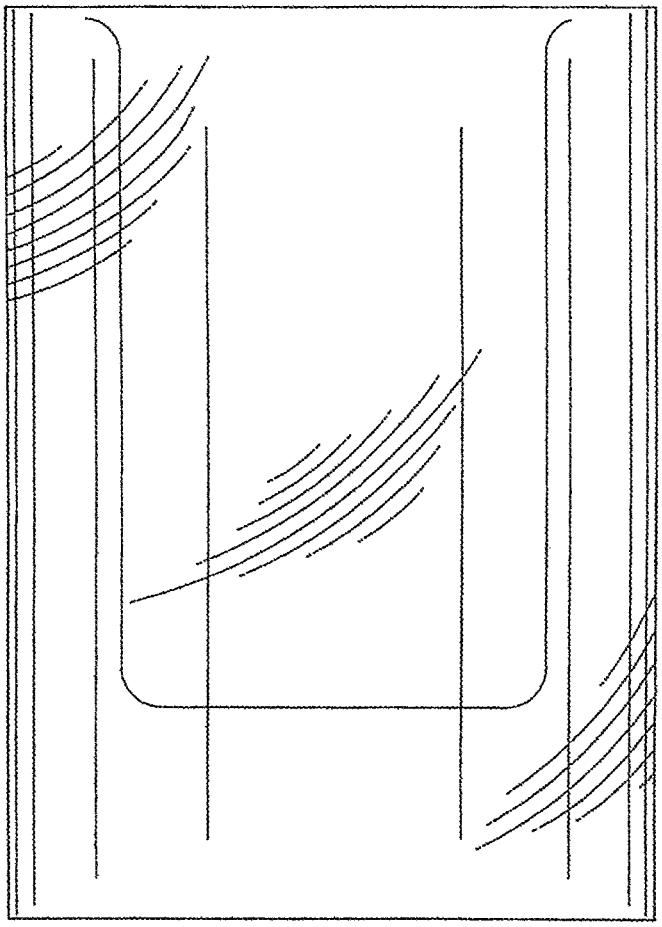
FIG. 12D is a side view of the pillar vase of FIG. 12C.
Figure 12E:
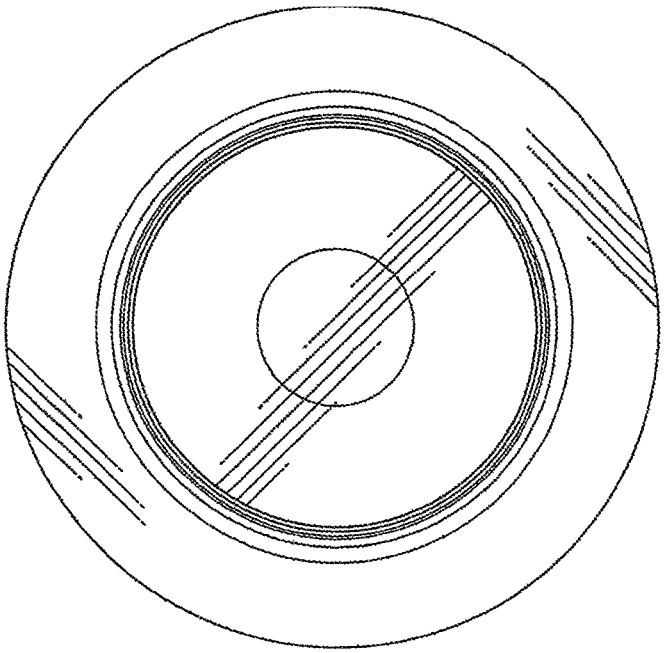
FIG. 12E is a top view of the pillar vase of FIG. 12C.
Figure 12F:
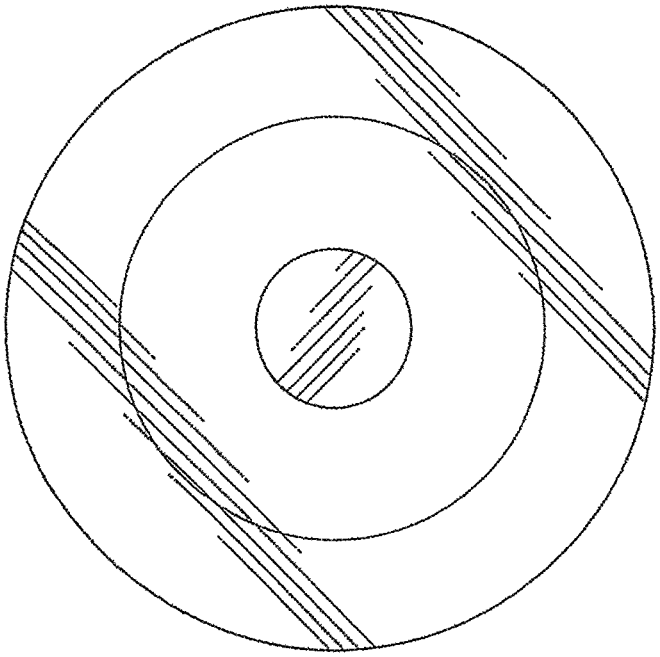
FIG. 12F is a bottom view of the pillar vase of FIG. 12C.

FIG. 12A is a cross section of a standard pillar vase constructed in accordance with the invention including a set of preferred dimensions. FIG. 12B is a cross section of a tall pillar vase constructed in accordance with the invention including a set of preferred dimensions. FIG. 12C is an oblique view of a pillar vase; FIG. 12D is a side view, FIG. 12E is a top view, and FIG. 12F is a bottom view.

Figure 13A:
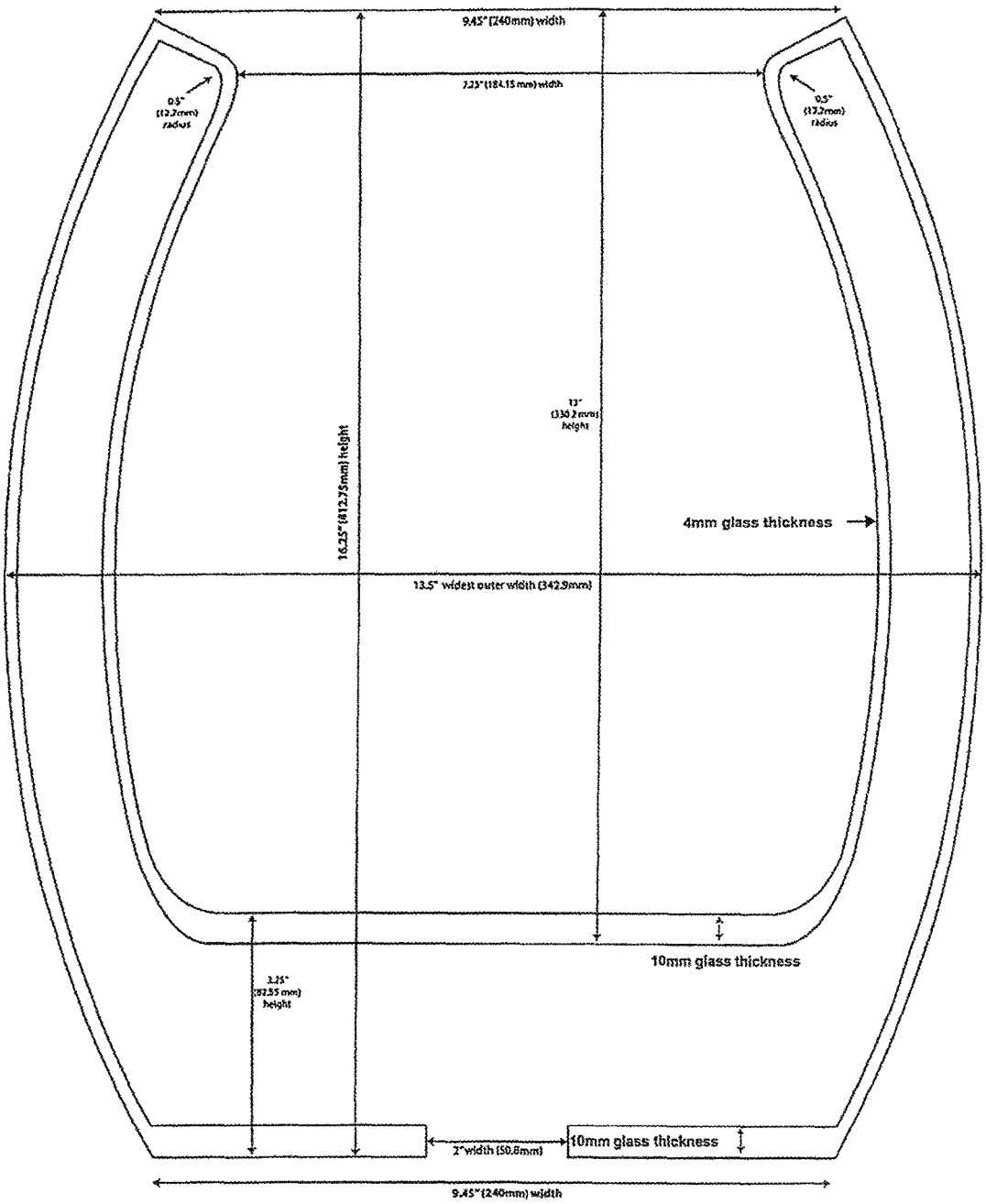
FIG. 13A is a cross section of a large tapered floral vase constructed in accordance with the invention including a set of preferred dimensions.
Figure 13B:
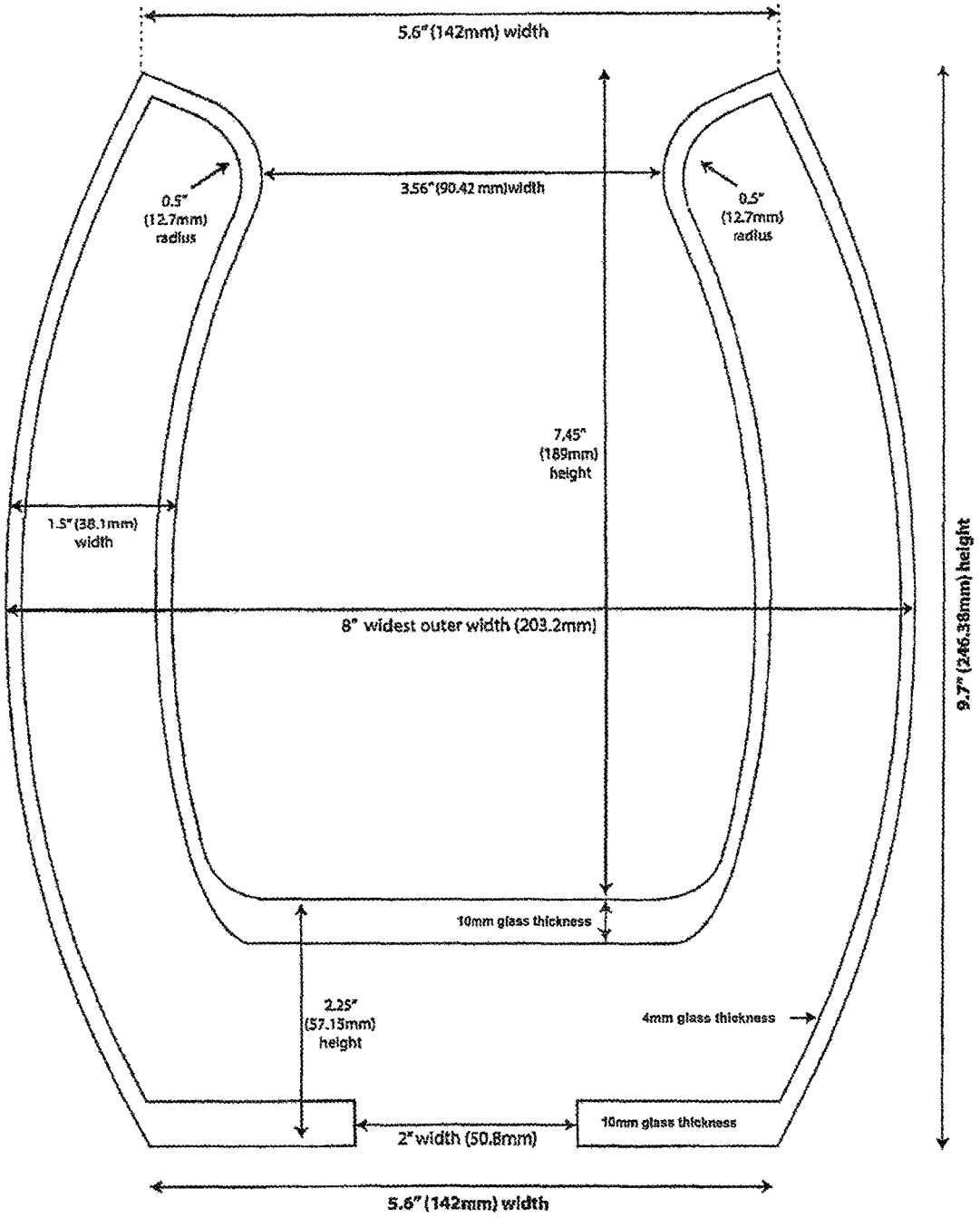
FIG. 13B is a cross section of a standard tapered floral vase constructed in accordance with the invention including a set of preferred dimensions.
Figure 13C:
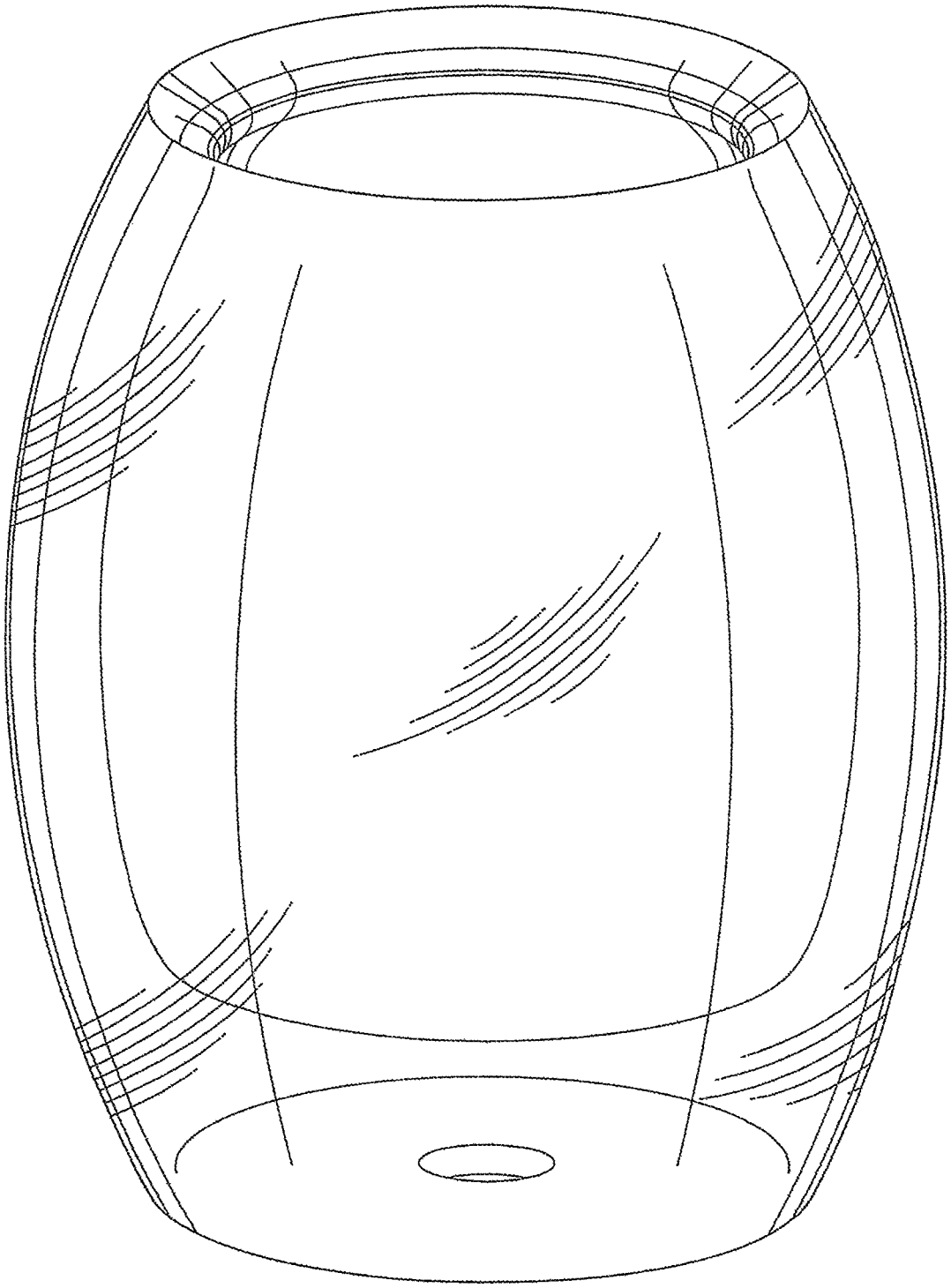
FIG. 13C is an oblique view of a tapered floral vase.
Figure 13D:
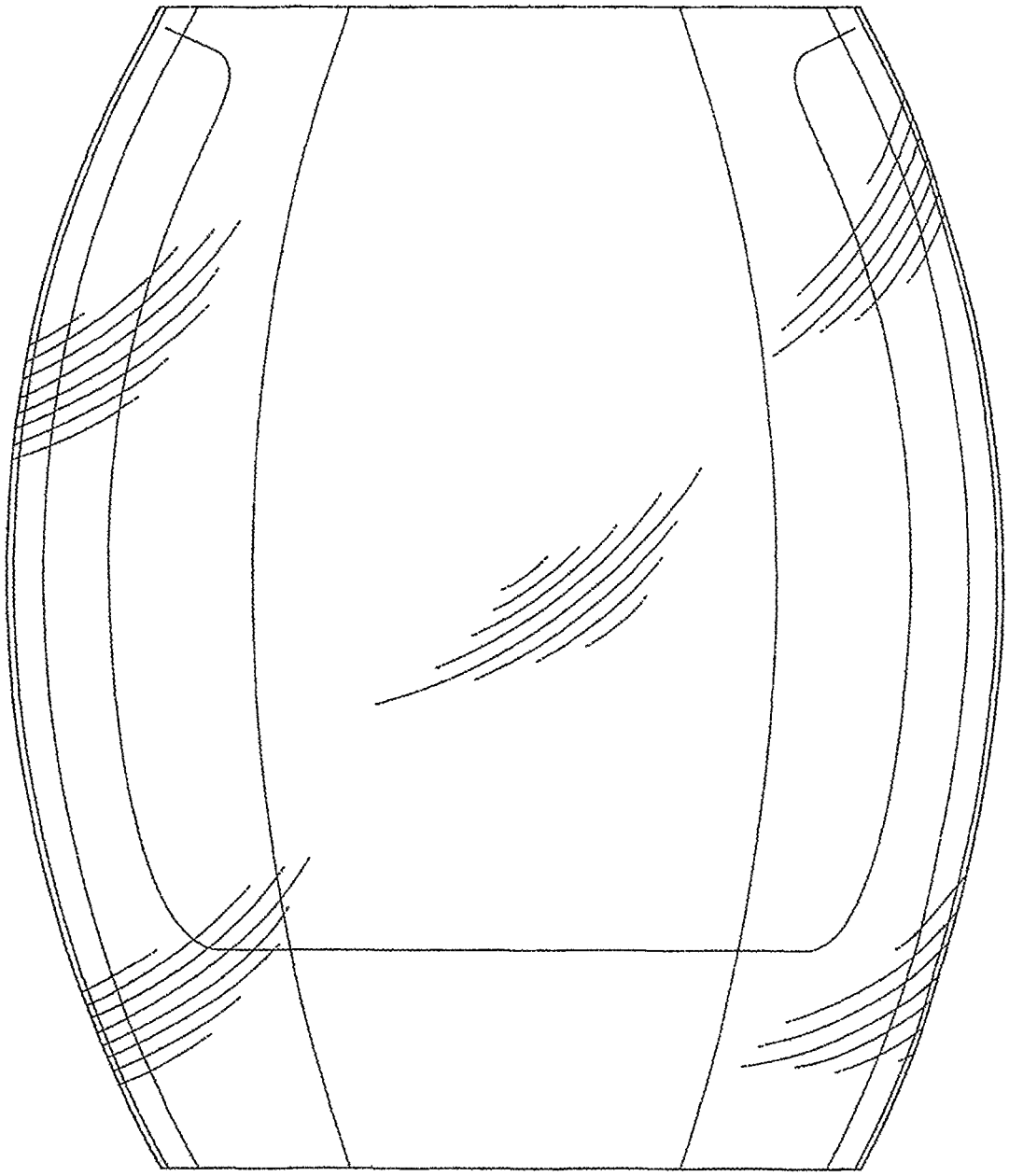
FIG. 13D is a side view of the tapered floral vase of FIG. 13C.
Figure 13E:
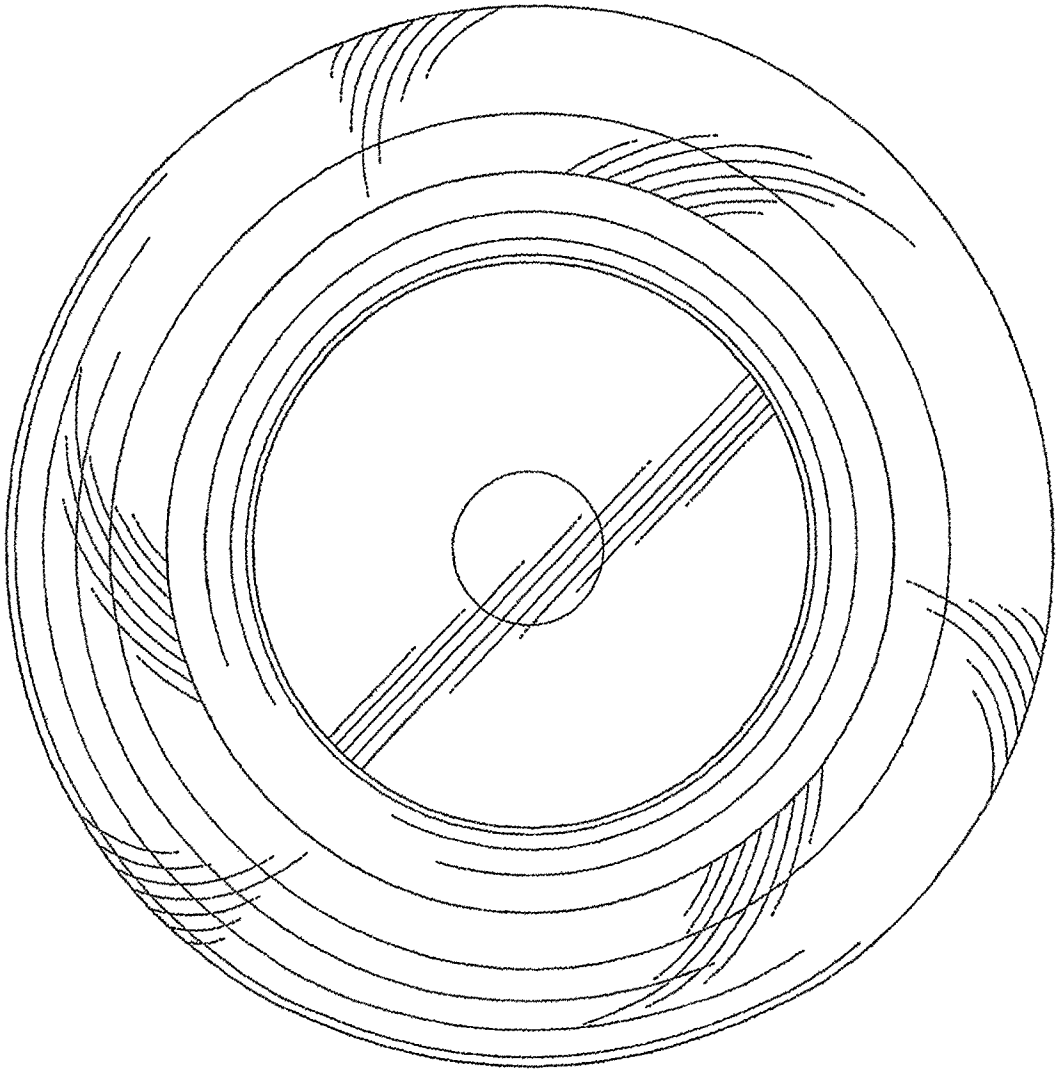
FIG. 13E is a top view of the tapered floral vase of FIG. 13C.
Figure 13F:
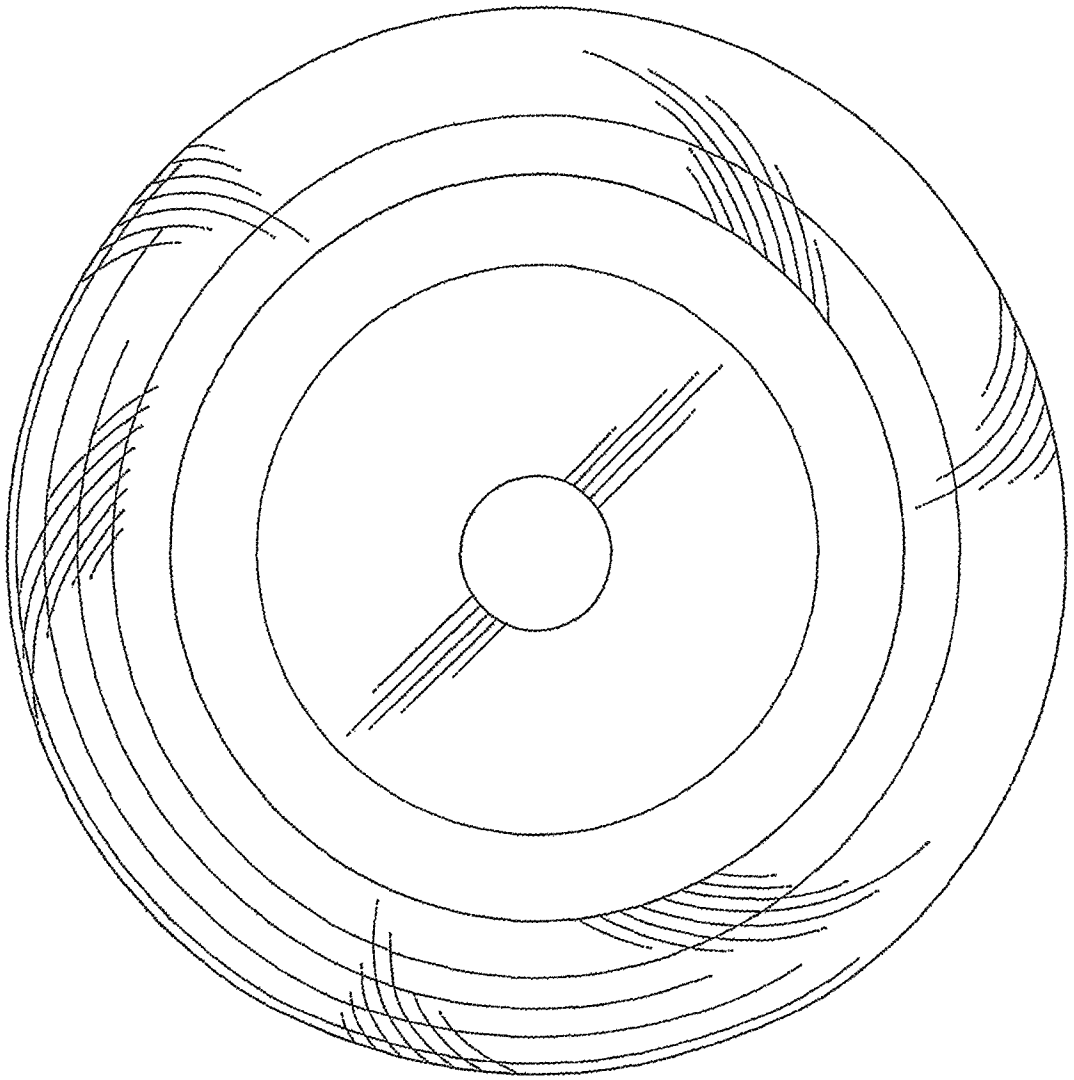
FIG. 13F is a bottom view of the tapered floral vase of FIG. 13C.

FIG. 13A is a cross section of a large tapered floral vase constructed in accordance with the invention including a set of preferred dimensions. FIG. 13B is a cross section of a standard tapered floral vase constructed in accordance with the invention including a set of preferred dimensions. FIG. 13C is an oblique view of a tapered floral vase, FIG. 13D is a side view, FIG. 13E is a top view, and FIG. 13F is a bottom view.

Figure 14A:
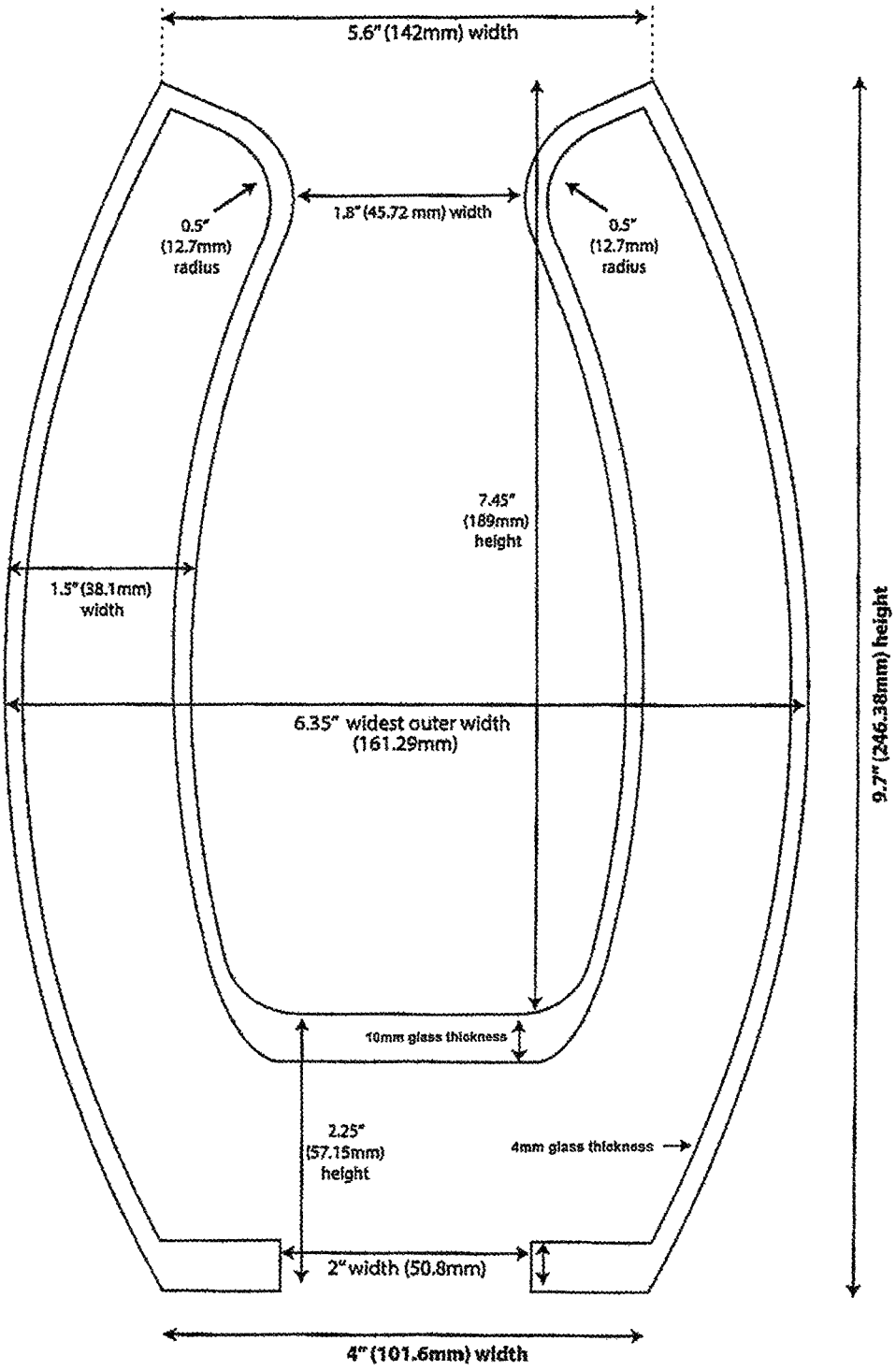
FIG. 14A is a cross section of a floral bud vase constructed in accordance with the invention including a set of preferred dimensions.
Figure 14B:
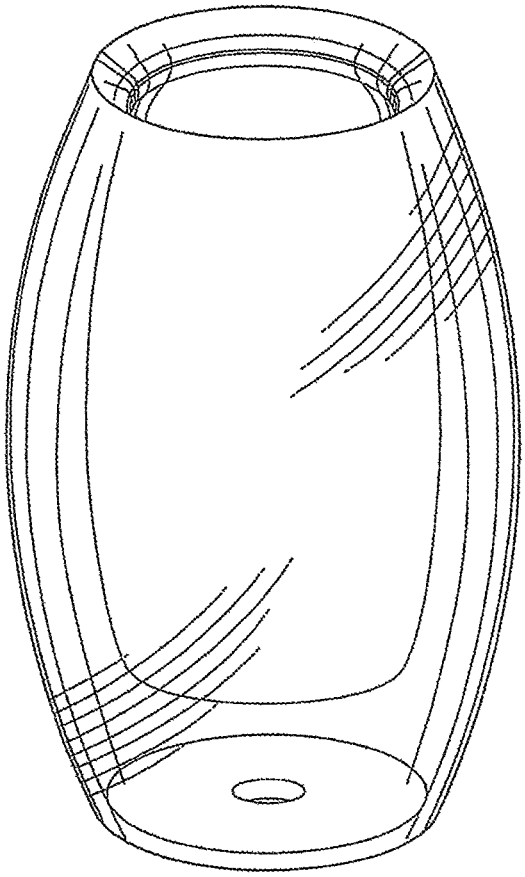
FIG. 14B is an oblique view of the floral bud vase of FIG. 14A.
Figure 14C:
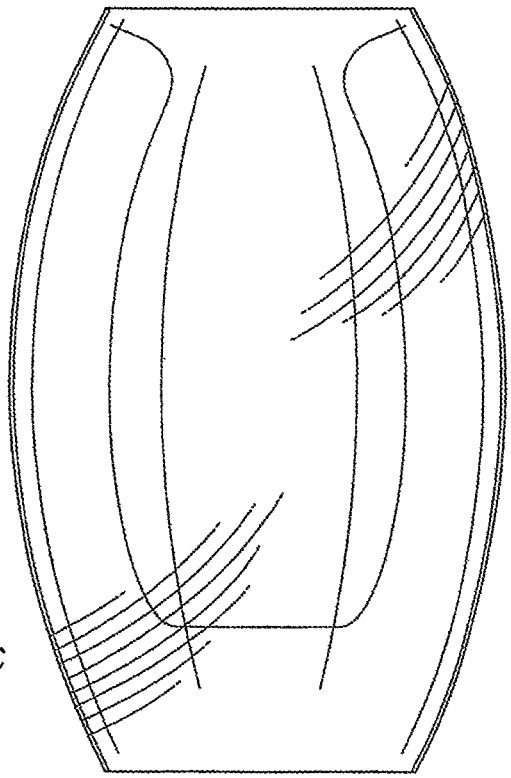
FIG. 14C is a side view of the floral bud vase of FIG. 14A.
Figure 14D:
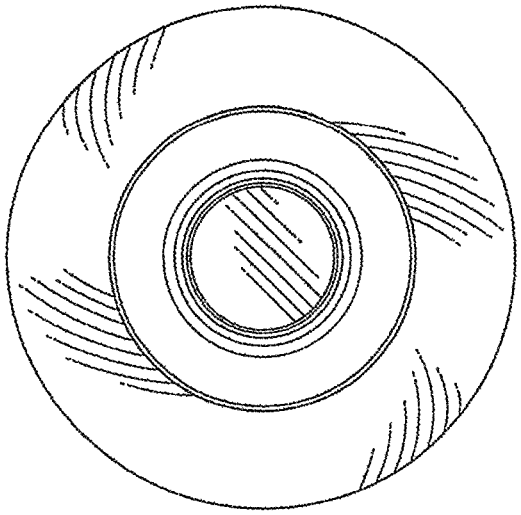
FIG. 14D is a top view of the floral bud vase of FIG. 14A.
Figure 14E:
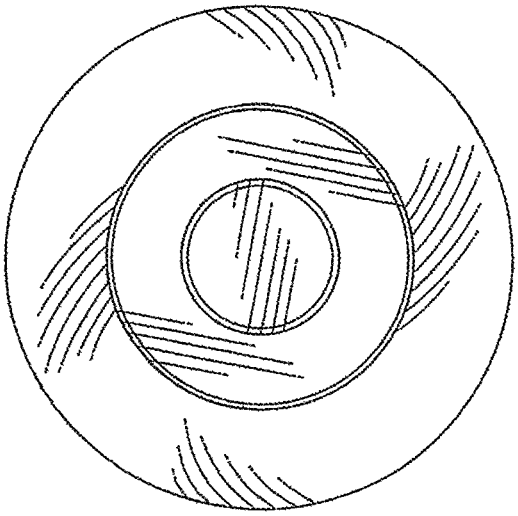
FIG. 14E is a bottom view of the floral bud vase of FIG. 14A.

FIG. 14A is a cross section of a floral bud vase constructed in accordance with the invention including a set of preferred dimensions. FIG. 14B is an oblique view of the floral bud vase of FIG. 14A; FIG. 14C is a side view, FIG. 14D is a top view, and FIG. 14E is a bottom view.

Figure 15A:
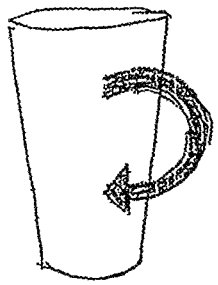
FIGS. 15A-15F show the way in which an article according to the invention may be turned upside down to receive filler material(s)
Figure 15B:
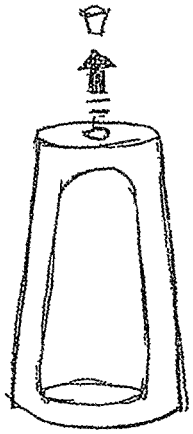
Figure 15C:
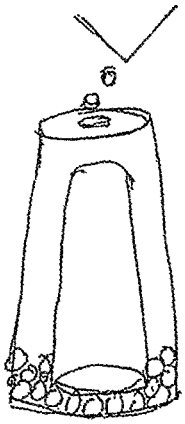
Figure 15D:
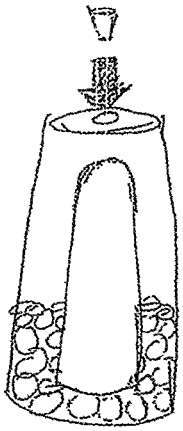
Figure 15E:
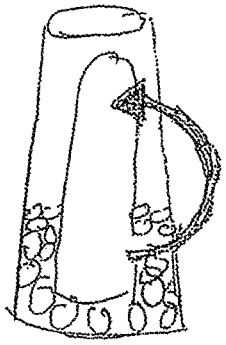
Figure 15F:
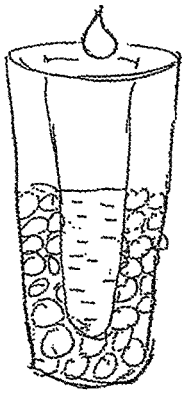

FIGS. 15A-15F show the way in which an article according to the invention may be turned upside down to receive filler material(s). FIG. 15A shows the article being turned upside down. FIG. 15B shows the plug or stopper being removed. FIG. 15C illustrates decorative accents being added to the volume between the inner and outer forms. FIG. 15D shows the plug being re-inserted. The article is turned over at FIG. 15E, and water (or candles or other substances) are added at FIG. 15F.

Figure 16:
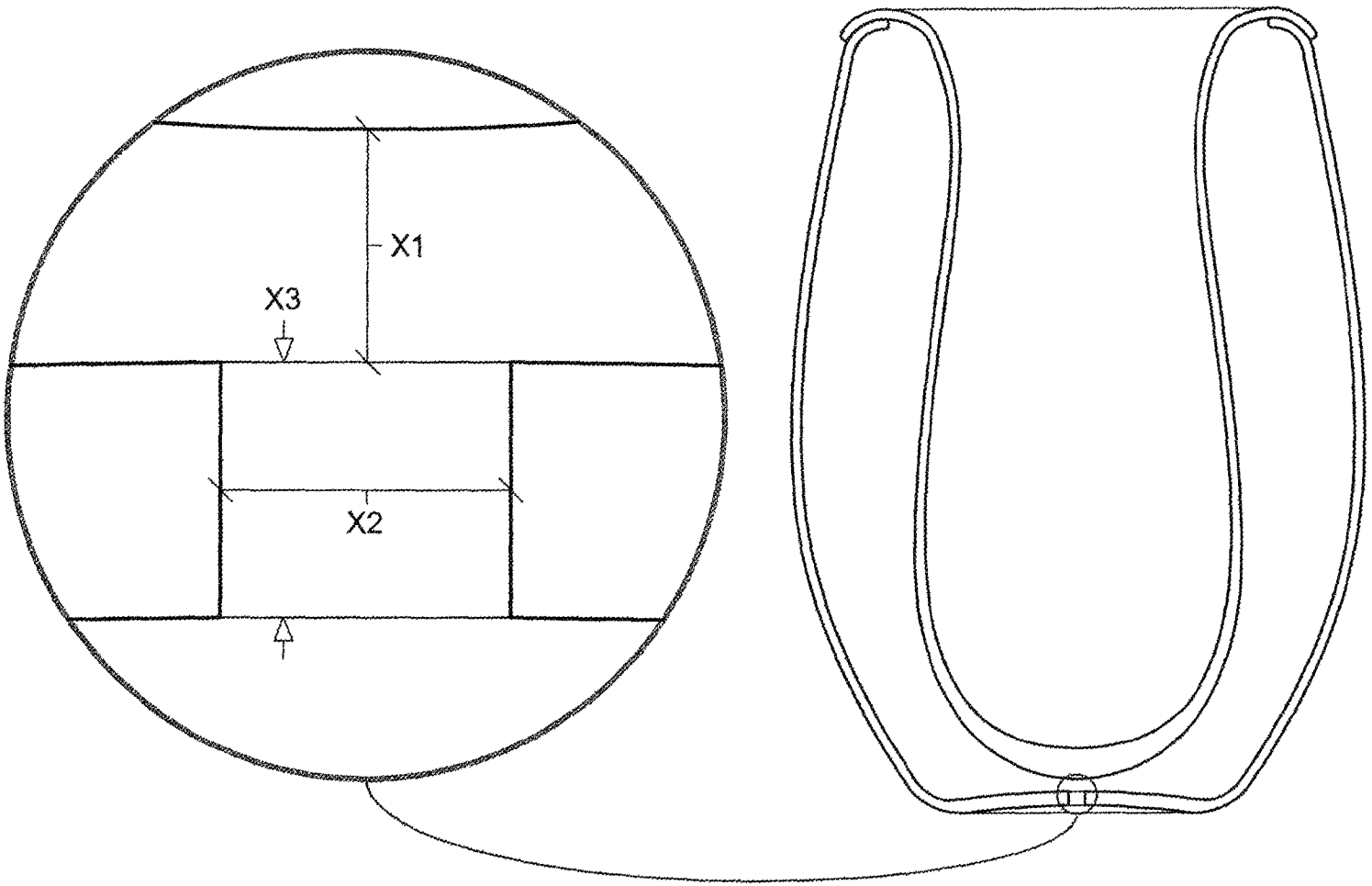
FIG. 16 is a drawing used to illustrate certain dimensions associated with preferred embodiments of the invention.

Given that embodiments of this invention are constructed from glass, and that the articles are configured to receive decorative filler materials as described above, the dimensions associated with the bottom filler hole are important. FIG. 16 is a drawing used to illustrate these dimensions. Specifically, X1 is defined as the Strike Point Distance Limit; X2 is the Base Opening Diameter Limit; and X3 is the Base Opening Thickness Limit.

As shown in FIG. 16, X1 is the distance between the "Strike Point" (the bottommost point on the surface of the outer wall of the inner vessel) and the inner surface of the outer form surrounding the opening or hole in the base or bottom of the vessel. X2 is the diameter (or minimum dimension) of the opening or hole itself. Given that articles anticipated by the invention may be filled with solid objects, a minimum value of X1 and X2 is necessary for a reasonable amount of different kinds and sizes of solid objects to be introduced into the interior cavity of the vessel. While larger distances may be desirable for larger filler materials such as rocks, shells, and the like, a preferred minimum dimension for X1 and X2 is in the range of 0.25-0.5 inches to accommodate the practical use of the decorative products described herein. Note that while X1 and X2 may be the same, they need not be.

X3 is the thickness of the outer form or vessel in the immediate vicinity where the opening is cut, cored or otherwise formed. The minimum thickness of X3 is in the range of 0.12-0.25 inches. This minimum dimension is important to the ergonomics of the invention; in particular, that the interior cavity is readily accessible via a re-sealable cap to be easy or efficiently to opened/closed by hand and functionally work. A certain amount of space or thickness is necessary for fingers to be able to grab onto an opening mechanism, and it has been discovered that X3 in the range of 0.12-0.25 inches is fundamental for the practical use of the decorative product described herein.

Whereas embodiments thus described include a removable/replaceable plug enabling the bottom of the vessel itself to rest on a support surface, in alternative embodiments the removable/replaceable plug may cover more of the bottom of the vessel and act as a base for the vessel. As an example, FIG. 17 is a side view of an alternative embodiment of the invention wherein a removably replaceable plug 1704 also function as a base for vessel 1702, which may or may not be double-walled as shown.

Figure 17:
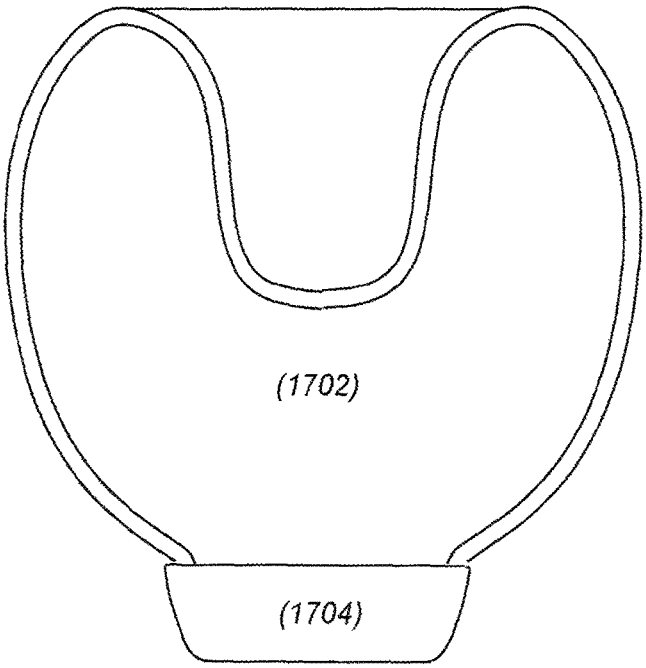
FIG. 17 is a side view of an alternative embodiment of the invention wherein a removeably replaceable plug also function as a vessel base.
Figure 19:
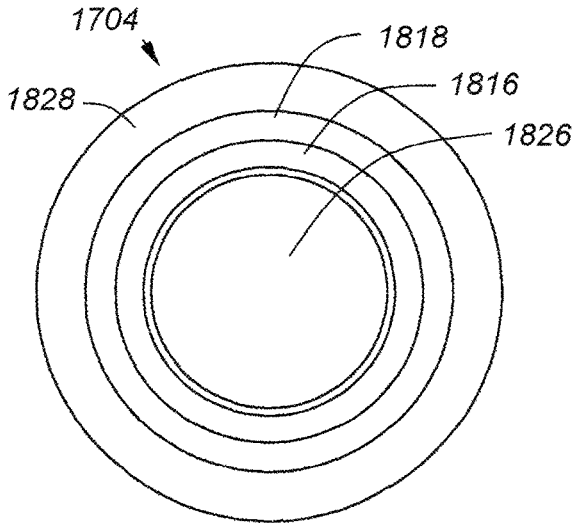
FIG. 19 is top-down view of the base of FIG. 18.
Figure 20:
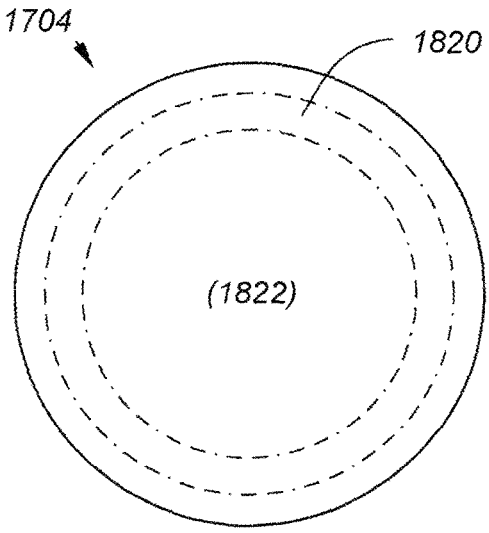
FIG. 20 is bottom-up view of the base of FIG. 18.
Figure 18:
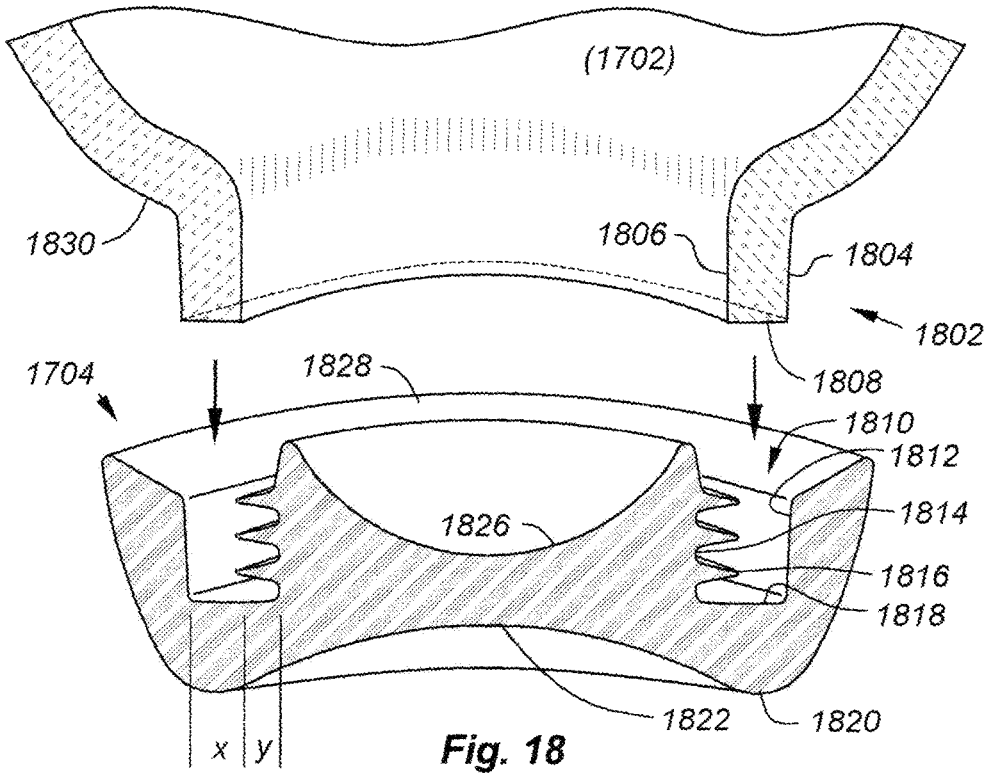
FIG. 18 is a view in partial cross section that illustrates how a vessel fits into the base of FIG. 17.

FIG. 18 is a view in partial cross section that illustrates how a vessel fits into the base of FIG. 17. The vessel 1702 has a bottom opening defined by a rim 1802 with an inner concave wall surface 1806, an outer convex wall surface 1804, and a bottom wall surface 1808 that may be flat as shown. The wall surfaces 1804, 1806 may be oriented vertically and parallel to one another. In preferred embodiments the rim and receiving groove in the base 1704 are circular though oval and other shapes are possible particularly with rounded corners.

Figure 22:
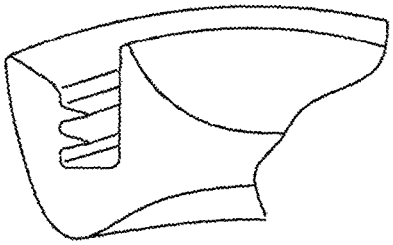
FIG. 22 shows how resilient ribs may be placed on an opposing wall of a groove in the base.
Figure 23:
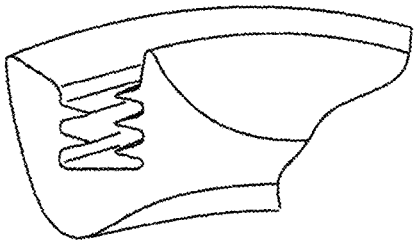
FIG. 23 depicts resilient ribs on both opposing walls of a groove in a base.

The base 1704 has a continuous groove 1810 defining an inner concave sidewall 1814, an outer convex sidewall 1812, and a bottom surface 1818. One or more ribs or corrugations 1816 extend from one or both of the sidewalls 1814, 1812, such that when the rim of the vessel is received by the groove a liquid-tight seal is achieved. FIG. 18 shows three ribs or corrugations extending from the inner sidewall, extending radially outwardly into the groove 1810, with the understanding that more or fewer such ribs or corrugations 1816 may extend from either or both of the sidewalls. FIG. 22 shows ribs from the outer sidewall 1812, and FIG. 23 illustrates ribs extending outwardly from both sidewalls.

Figure 21:
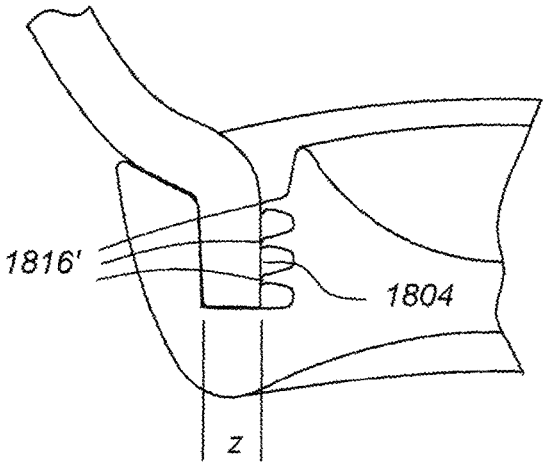
FIG. 21 is a detailed diagram showing how resilient ribs are deformed to achieve a liquid-tight seal.

The invention is not limited in terms of exact dimensions. However, in preferred embodiments the height of the base may be in the range of 1 to 2 inches, with a radius in the range of 2 to 6 inches or more. The rim of the vessel may have a thickness "z" on the order of 0.25 to 0.75 inches, more preferably about 0.5 +/−0.125". The width "x" of the groove including the ribs or corrugations is slightly less than the thickness of the rim to ensure that the distal edge of the rib(s), having a length "y," deform against a wall surface of the rim to provide a water-tight seal. FIG. 21 shows three ribs 1816' pressing against the inner concave wall surface of the vessel rim.

In the preferred embodiment, the base is molded from a single piece or compressible/resilient material such as silicone. The upper surface of the base may include a concave depression 1826 largely for decorative purposes, whereas the bottom surface may also include a depression 1822 to that the base rests on a more stable edge 1820 which may be circular. When seated in the base, surfaces 1828 and 1830 may abut one another for a smooth transition between the vessel and the base.

The invention claimed is:

1. A decorative double-walled vessel, comprising:

an inner form defining a receptacle having a sidewall with an inner surface and an outer surface;

an outer form having a sidewall with an inner surface and an outer surface, and wherein the outer form is spaced apart from the inner form to create a cavity between the outer surfaces of the inner form and the inner surfaces of the outer form;

a bottom opening in the outer form enabling solid decorative filler materials to be introduced into the cavity such that the decorative materials do not enter into the receptacle;

wherein the outer form bulges outwardly between an upper portion and the bottom opening to define an outermost outer surface;

wherein the bottom opening defines a downwardly extending circular rim having a convex outer surface and a concave inner surface;

a vessel base having an outer sidewall, an upper portion and a bottom surface adapted to rest against a support surface;

the upper portion of the vessel base including a continuous circular groove with inner and outer opposing sidewalls configured to receive the rim of the vessel such that the inner sidewall of the of the base makes contact continuous with the concave inner surface of the rim and the outer sidewall of the base makes continuous contact with the convex outer surface of the rim;

wherein the downwardly extending circular rim of the vessel is cylindrical in shape, and wherein the cylindrical rim is inserted directly into the continuous circular groove of the vessel base;

wherein at least one of the inner and outer surfaces of the base includes at least one compressible, resilient corrugation so as to provide a watertight seal when the rim is inserted into the groove; and wherein the outer sidewall of the vessel base defines a diameter that is smaller than the outermost outer surface of the outer form.

2. The decorative vessel of claim 1, wherein the vessel is made of glass or plastic.

3. The decorative vessel of claim 1, wherein the corrugation of the base extends radially from one or both of the sidewalls and into the groove.

4. The decorative vessel of claim 1, including a plurality of corrugations in the base that extend radially from one or both of the sidewalls and into the groove.

5. The decorative vessel of claim 1, wherein the base is molded from a single piece of flexible, resilient material.

6. The decorative vessel of claim 1, wherein the bottom surface of the base includes a depression creating a ridge that rests against the support surface.

7. The decorative vessel of claim 1, wherein the bottom surface of the base includes a depression creating a ridge that rests against a support surface.

* * * * *